US007127756B2

(12) United States Patent
Brophy et al.

(10) Patent No.: US 7,127,756 B2
(45) Date of Patent: Oct. 31, 2006

(54) MATERNITY BED FOOT SUPPORT AND ABDUCTION ASSEMBLY

(75) Inventors: Joseph Thomas Brophy, Rockford, MI (US); Andras Kupfermann, Grand Rapids, MI (US); Arlene Krecow, Mattawan, MI (US); Todd Trevor Andres, Sparta, MI (US); Chad Allen Wolf, Ann Arbor, MI (US); Richard Anthony Derenne, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 146 days.

(21) Appl. No.: 11/004,705

(22) Filed: Dec. 3, 2004

(65) Prior Publication Data

US 2006/0117485 A1 Jun. 8, 2006

(51) Int. Cl.
*A61G 13/12* (2006.01)

(52) U.S. Cl. ..... 5/602; 5/624; 5/648; 5/651

(58) Field of Classification Search ..... 5/602, 5/624, 648–651; 128/882
See application file for complete search history.

(56) References Cited

U.S. PATENT DOCUMENTS 2,067,891 A * 1/1937 Comper ..... 5/624
2,275,973 A 3/1942 Marchbanks
2,552,370 A 5/1951 Curtis
2,605,151 A 7/1952 Shampaine
3,492,679 A 2/1970 Drew
4,025,972 A 5/1977 Adams et al.
4,097,939 A 7/1978 Peck et al.
4,139,917 A 2/1979 Fenwick
4,225,127 A 9/1980 Strutton
4,411,035 A 10/1983 Fenwick
4,639,954 A 2/1987 Speed
4,860,394 A 8/1989 Benessis et al.
4,894,876 A 1/1990 Fenwick
5,148,562 A 9/1992 Borders et al.
5,157,800 A 10/1992 Borders
5,214,812 A 6/1993 Bartow et al.
5,226,187 A 7/1993 Borders et al.
5,329,657 A 7/1994 Bartley et al.
5,423,097 A 6/1995 Brulé et al.
5,774,914 A 7/1998 Johnson et al.
5,926,878 A 7/1999 Morton et al.
6,282,738 B1 * 9/2001 Heimbrock et al. ..... 5/618

(Continued)

OTHER PUBLICATIONS

Stryker Adel 2100 Childbearing Bed, Service Manual, 1988, pp. 1-28.

(Continued)

*Primary Examiner*—Michael Trettel
(74) *Attorney, Agent, or Firm*—Flynn, Thiel, Boutell & Tanis, P.C.

(57) ABSTRACT

A foot support and abduction assembly includes an abductor configured for pivotal attachment proximate a foot end of a maternity bed. The foot support is configured for locating in a stowed position below the abductor, and a calf support is attached to an undersurface of the foot support. An upright assembly has a first end that is secured to the abductor for longitudinal movement along a length of the abductor, a second end to which the foot support is movably mounted, and a locking mechanism for selectively securing the upright assembly in one of a plurality of positions along the length of the abductor. The upright assembly is further configured for movement from a deployed position to a stowed position, and the locking mechanism is unlocked when the upright assembly is in the stowed position.

21 Claims, 29 Drawing Sheets

U.S. PATENT DOCUMENTS

| | | | | |
|---|---|---|---|---|
| 6,654,974 | B1 | 12/2003 | Ruchl et al. | |
| 6,757,924 | B1 | 7/2004 | Goodwin et al. | |
| 6,857,153 | B1 * | 2/2005 | Ruehl et al. | 5/600 |

OTHER PUBLICATIONS

Stryker Adel 500XL Childbearing Bed, Service Manual 1986 pp. 1-16.

Stryker Adel 2100EC Childbearing Bed, Ultimate convenience and comfort, Jan. 1994 (6 pages).

Stryker Adel 500XL Childbearing Bed, May 1995 (2 pages).

Stryker Medical, Labor & Delivery Model 5000 Series, Oct. 1996 (2 pages).

Co-pending U.S. Appl. No. 11/004,703, filed Dec. 3, 2004, Patient Support Apparatus With Removable Foot Section.

* cited by examiner

MATERNITY BED FOOT SUPPORT AND ABDUCTION ASSEMBLY

FIELD OF THE INVENTION

The invention relates to hospital beds and, more particularly, to a foot support and abduction assembly for a maternity bed, designed to ease the birthing process for both the mother and the medical personnel that are assisting her.

BACKGROUND OF THE INVENTION

An example of a foot support and abduction assembly can be found in U.S. Pat. No. 5,926,878, wherein the foot support and abduction assembly are mounted proximate a leg-foot section of a maternity bed. The foot support is rotatably mounted to an upright support and is rotatable from a first, use position to a second position wherein a leg support mounted on the back of the foot support is deployed to a use position. The upright support is rotatably and slidably mounted to an abductor and is rotatable from the upright, use position to an under-bed stowed position. The abductor is rotatably mounted to the maternity bed. Each movement of one of these elements requires release of a locking mechanism configured to secure the element in a selected position. Each release for a locking mechanism and movement of an element requires a two-handed operation by the attendant.

When the upright support, with attached foot support, is in the under-bed, stowed position, it has been found advantageous to have the sliding connection between the abductor and the upright support unlocked so that the upright support can be moved easily, or will give way if struck by hospital equipment or attendants. The attendant must remember to unlock the sliding mechanism when stowing the upright support.

It would be advantageous to provide integrated locking mechanisms for each element of the foot support and abduction assembly configured for one-handed unlocking and moving of the element by the attendant. It would be further advantageous to provide an automatic unlocking of the upright support sliding mechanism when in the stowed position.

SUMMARY OF THE INVENTION

A foot support and abduction assembly includes an abductor configured for pivotal attachment proximate a foot end of a maternity bed. The foot support is configured for locating in a stowed position below the abductor, and a calf support is attached to an undersurface of the foot support. An upright assembly has a first end that is secured to the abductor for longitudinal movement along a length of the abductor, a second end to which the foot support is movably mounted, and a locking mechanism for selectively securing the upright assembly in one of a plurality of positions along the length of the abductor. The upright assembly is further configured for movement from a deployed position to a stowed position, and the locking mechanism is unlocked when the upright assembly is in the stowed position.

DETAILED DESCRIPTION OF THE PREFERRED EMBODIMENT

Figure 1:
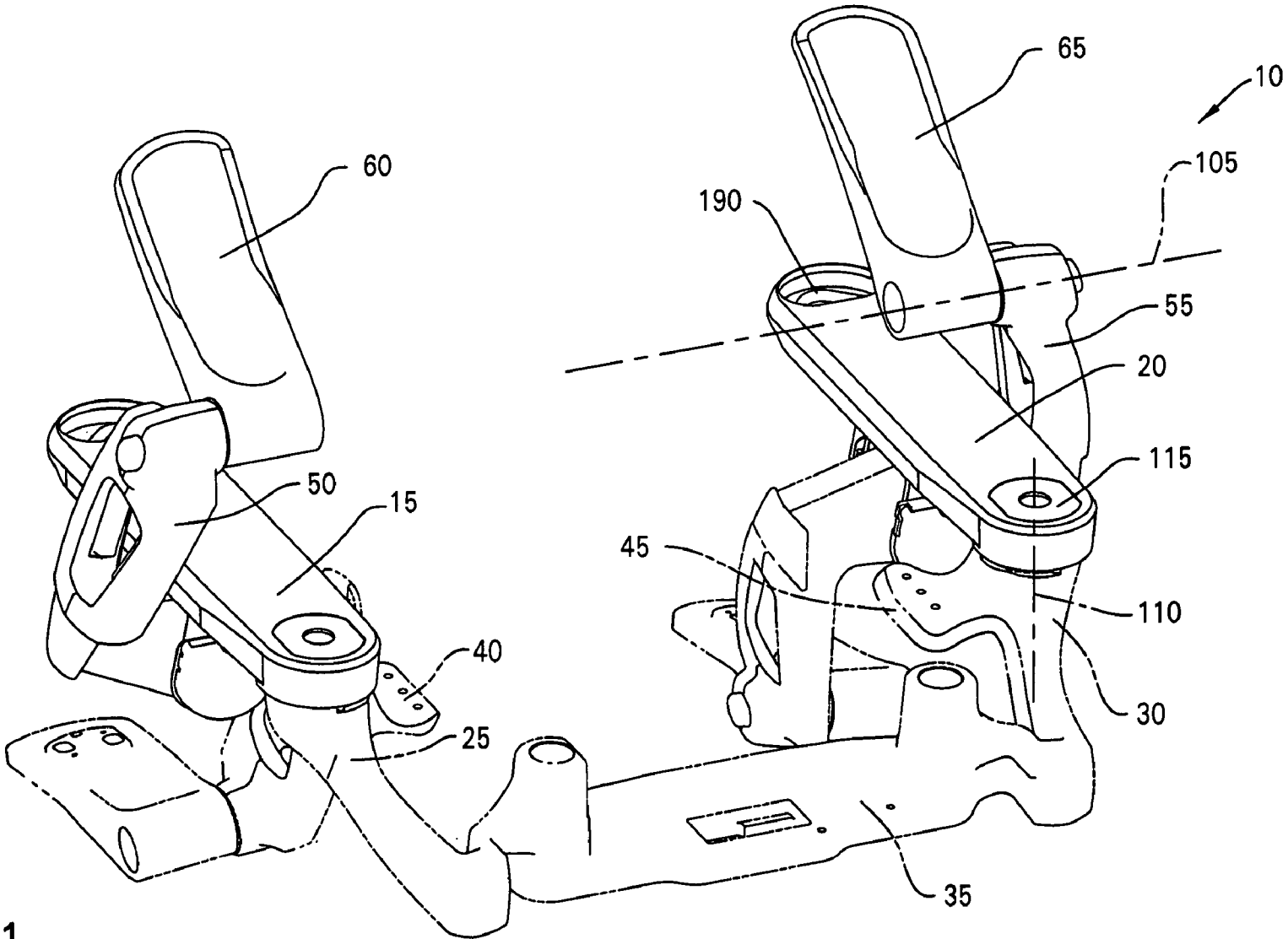
FIG. 1 is a perspective view of a maternity bed foot support and abduction assembly according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

Referring to FIG. 1, a maternity bed foot support and abduction assembly 10 is illustrated. The maternity bed foot support and abduction assembly 10 comprises a left abductor 15 and a right abductor 20, each pivotally attached to a respective stanchion 25, 30 formed as part of a bed foot lift casting 35 (shown in phantom). The bed foot lift casting 35 is configured for mounting to a foot end of a maternity bed (not shown). The bed foot lift casting 35 further includes a pair of integrally formed foot end support mounts 40, 45 configured for attaching a removable foot section of the maternity bed as disclosed in U.S. patent application Ser. No. 11/004,703, entitled "PATIENT SUPPORT APPARATUS WITH REMOVABLE FOOT SECTION", filed Dec. 3, 2004, incorporated herein by reference.

An upright assembly 50, 55 is pivotally attached to each of the abductors 15, 20 and pivotally supports a foot support 60, 65. As shown in FIG. 1, the upright assemblies 50, 55 are configured to pivot from an upright use orientation to a stowed orientation (shown in phantom) under the respective abductor 15, 20.

Further description of the maternity bed foot support and abduction assembly 10 will refer in detail to the right abductor 20 and pivotally supported upright assembly 55 and foot support 65. It is to be understood that the details of construction also apply to the left abductor 15 and associated upright assembly 50 and foot support 60, reversed as necessary for operating on the opposite side of the maternity bed.

Figure 2:
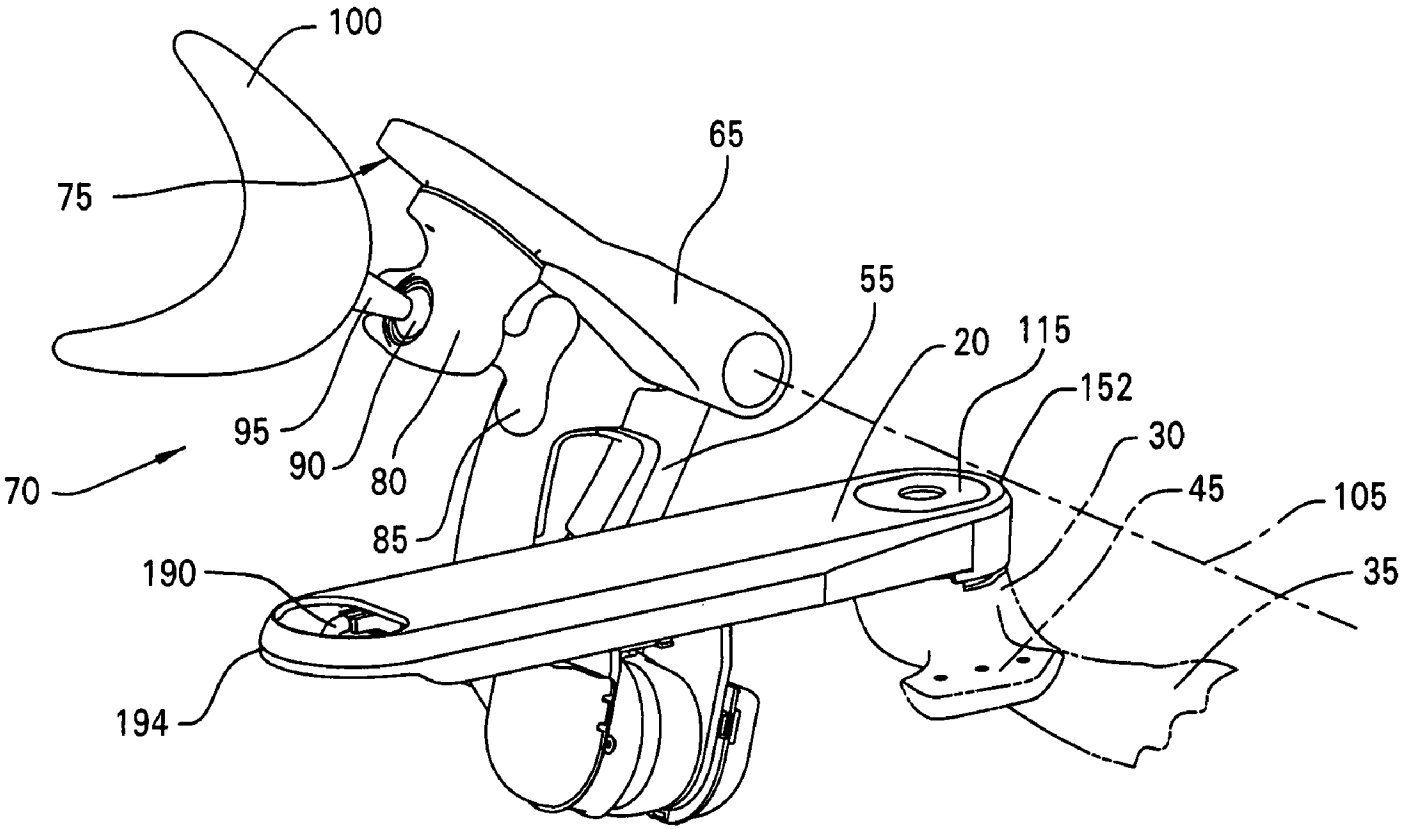
FIG. 2 is a perspective view according to FIG. 1 with an attached calf support assembly.

Referring to FIG. 2, a calf support assembly 70 is mounted to a reverse side 75 of the foot support 65. The calf support assembly 70 includes a mounting housing 80, a locking handle 85, a phenolic ball 90, a stanchion 95 and a calf support 100. The calf support 100 is configured for swivel adjustment relative to the housing 80. As will be further described below, the foot support 65 is pivotally mounted about a pivot axis 105 from a first position shown in FIG. 2, wherein the foot support 65 is directed toward a patient in the maternity bed, and a second position (not shown) wherein the foot support 65 is rotated toward the patient to present the calf support assembly 70 for use. In the remaining illustrations, the calf support assembly 70 has been omitted for clarity.

Figure 3:
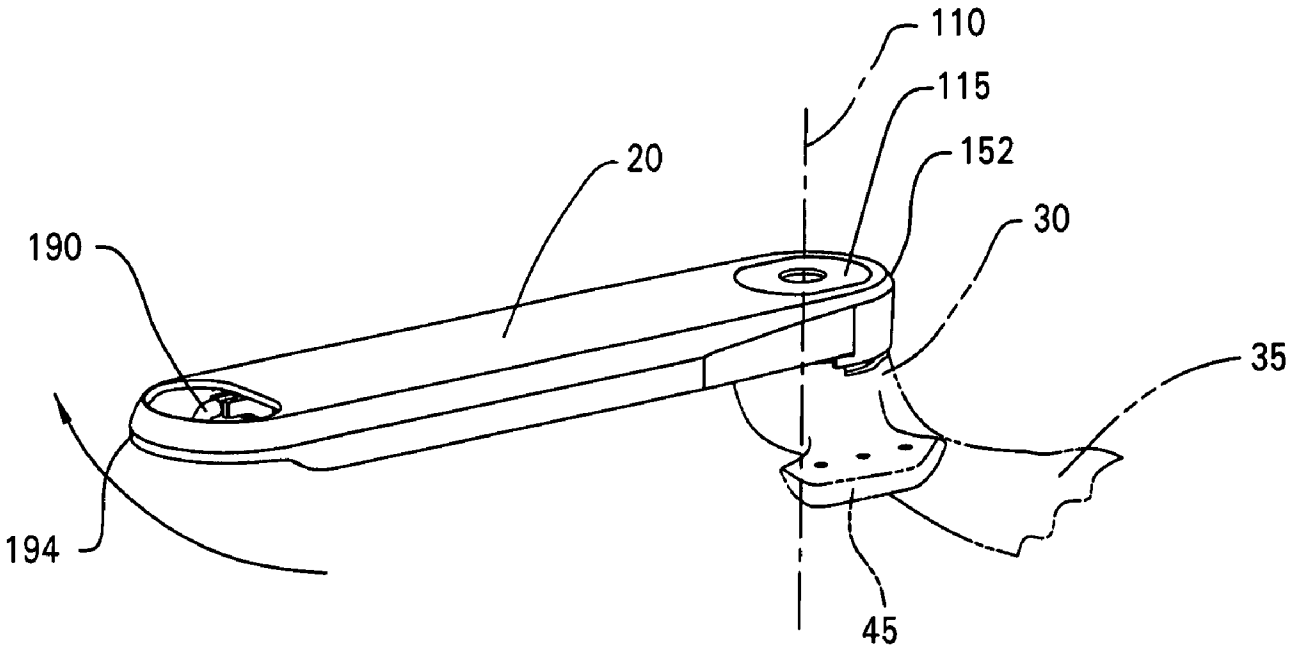
FIG. 3 is a perspective view of the abduction assembly according to FIGS. 1–2.
Figure 4:
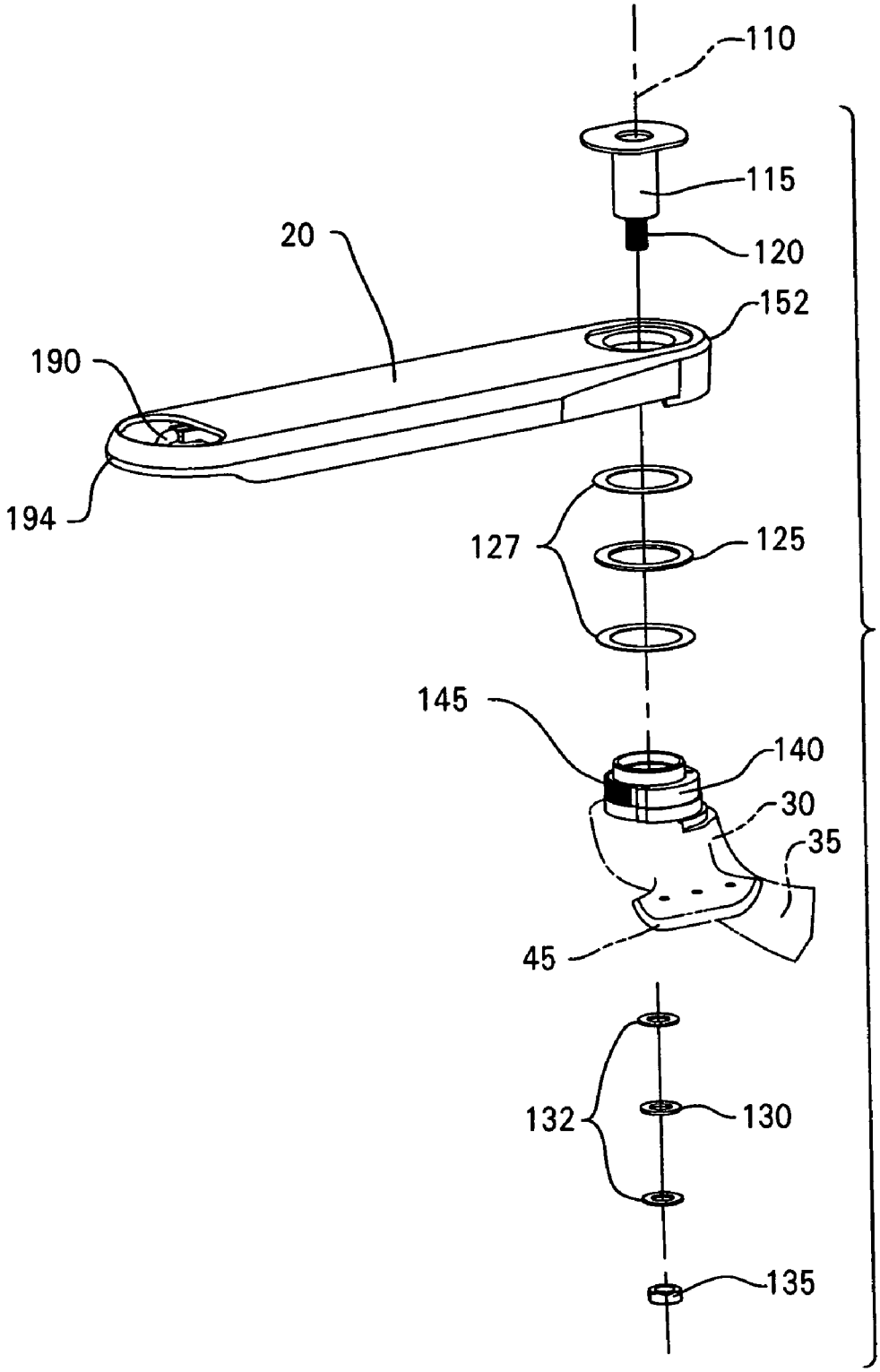
FIG. 4 is an exploded perspective view of the abduction assembly of FIG. 3.
Figure 5:
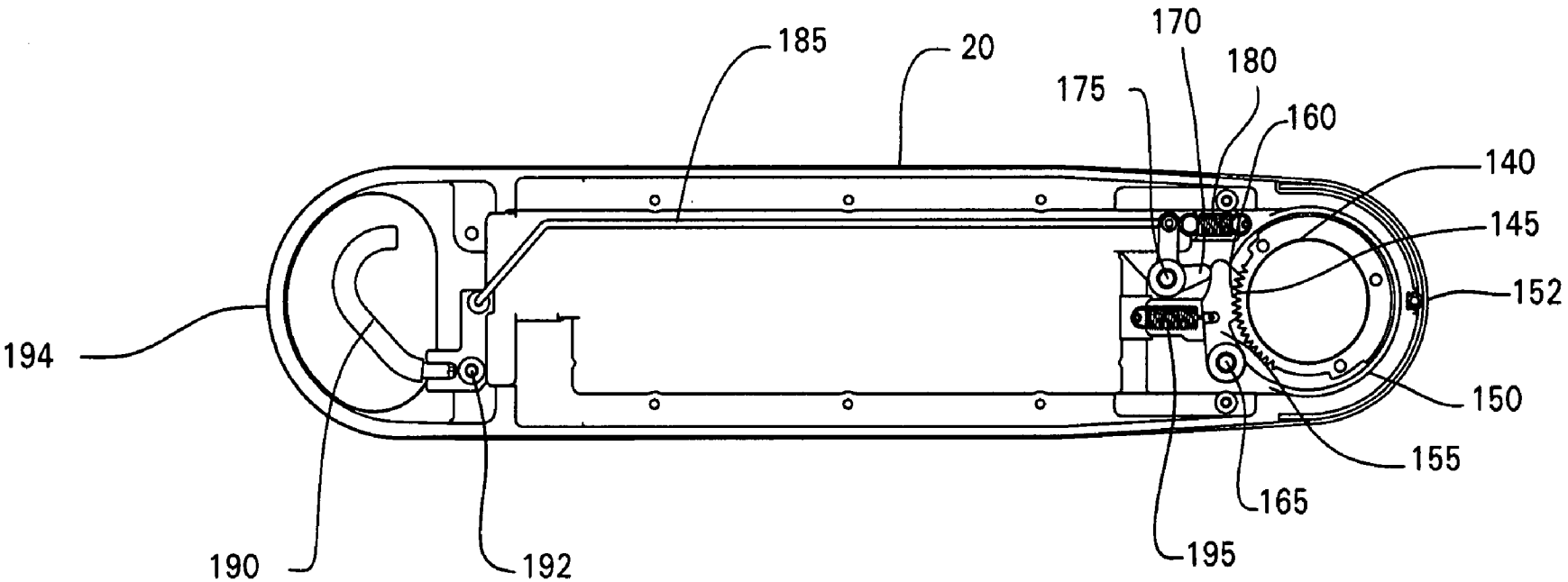
FIG. 5 is a bottom view of the abduction assembly of FIGS. 3–4.

Referring to FIGS. 3–5, the abductor 20 is pivotally mounted to the stanchion 30 of the bed foot lift casting 35 about a pivot axis 110. The abductor 20 is mounted to the stanchion 30 by a pivot shaft 115 having a threaded section 120. A pair of thrust bearings 125, 130 and washers 127, 132 are received on the pivot shaft 115 and threaded section 120, and secured by a nut 135 to enable the abductor 20 to rotate freely on the stanchion 30. The stanchion 30 further includes a ring gear 140 rotatably secured thereto having a plurality of teeth 145.

Referring to FIG. 5, the ring gear 140 is shown received in a cylindrical recess 150 within a proximal end 152 of the abductor 20. A latch member 155 having a plurality of teeth 160 is pivotally mounted by a pin 165 to the abductor 20. A locking cam 170 pivotally mounted to the abductor 20 by a pivot pin 175 is biased by a spring 180 to force the latch member 155 into engagement with the ring gear 140. The cam 170 is connected by a pull rod 185 to an abductor release handle 190 pivotally mounted to the abductor 20 by a pivot pin 192. The abductor release handle 190 is positioned at a distal end 194 of the abductor 20.

Figure 6:
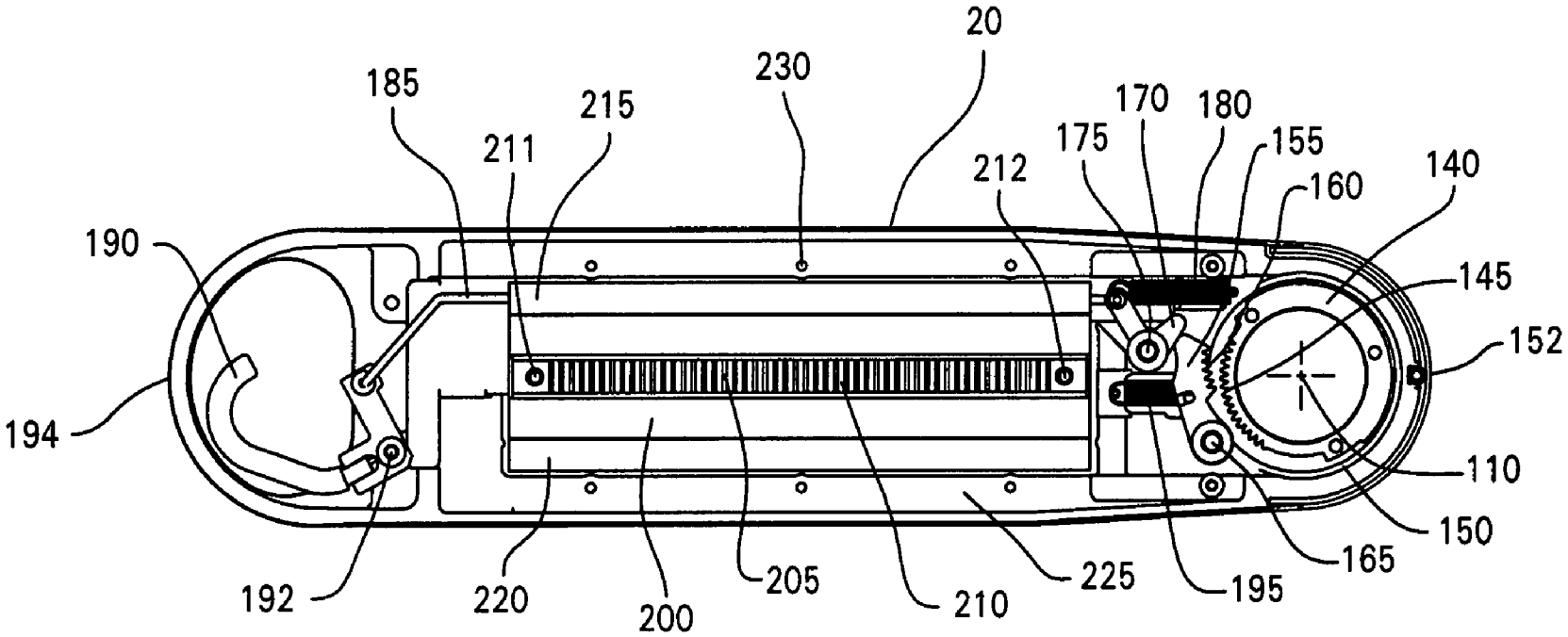
FIG. 6 is a bottom view of the abduction assembly according to FIGS. 3–5 with gear rack installed.

Referring to FIG. 6, actuation of the handle 190 draws the locking cam 170 away from the latch member 155. A spring 195 then draws the latch member 155 away from the ring gear 140 so that the teeth 145 of the ring gear 140 are no longer engaged with the teeth 160 of the latch member 155. With the teeth 145, 160 disengaged, the abductor 20 is free to pivot about the axis 110 on the stanchion 30. The springs 180, 195 are selected so that when the handle 190 is released, the spring 180 will overcome the spring 195 to urge the latch member 155 into engagement with the ring gear 140.

Figure 7:
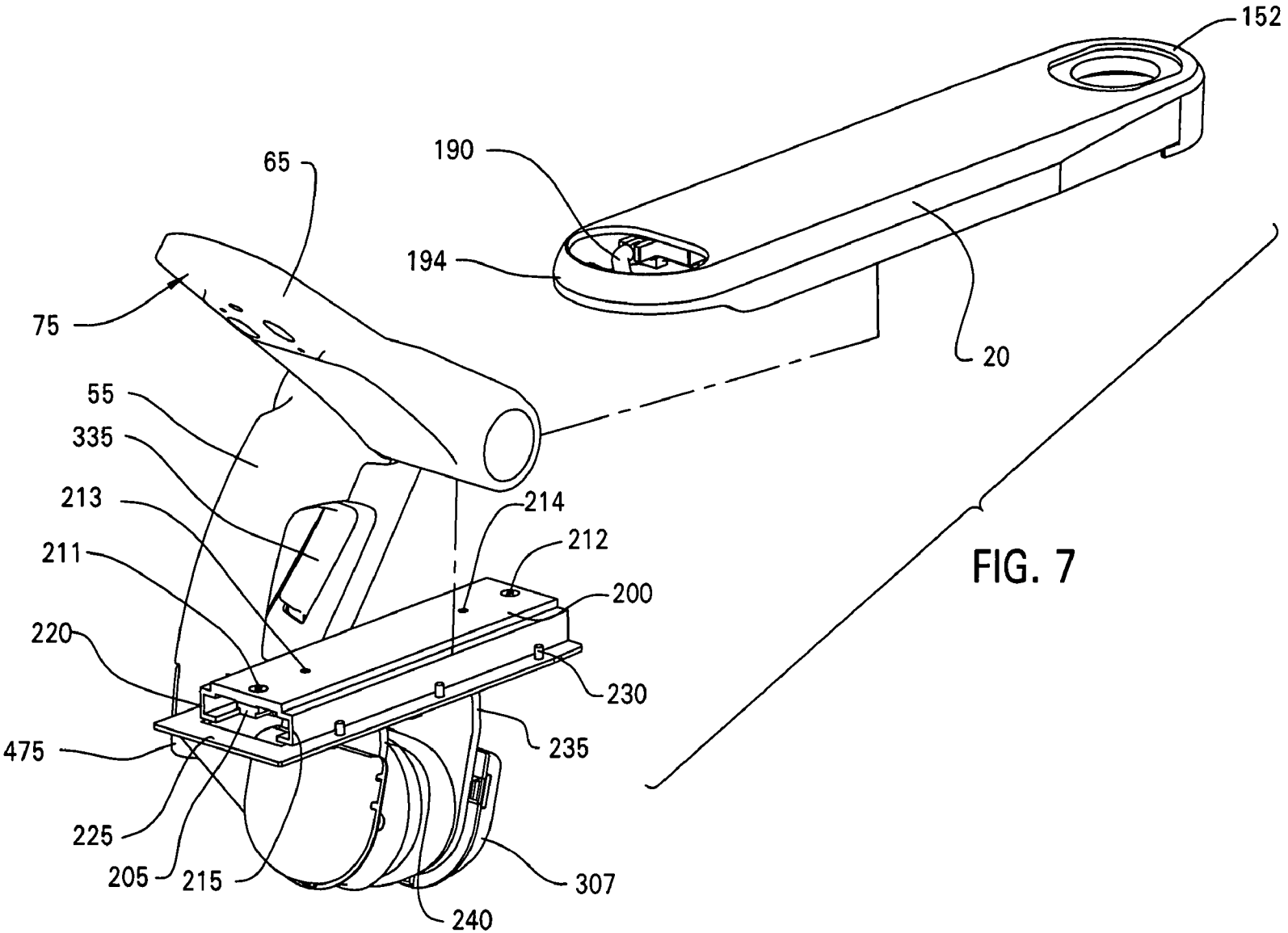
FIG. 7 is a perspective view of the foot support and abduction assembly according to FIGS. 1–6.

The abductor 20 further includes a rack assembly 200 including a longitudinal rack 205 having a plurality of teeth 210. The rack assembly further includes a pair of longitudinal tracks 215, 220. The rack assembly 200 is secured to the underside of the abductor 20 by a bottom cover 225, secured by a plurality of fasteners 230. The rack assembly 200 is configured for slidably receiving the upright assembly 55 (FIG. 7). The rack section 205 is secured to the rack assembly 200 by a pair of fasteners 211, 212 and a pair of pins 213, 214 (FIG. 8A).

Figure 8A:
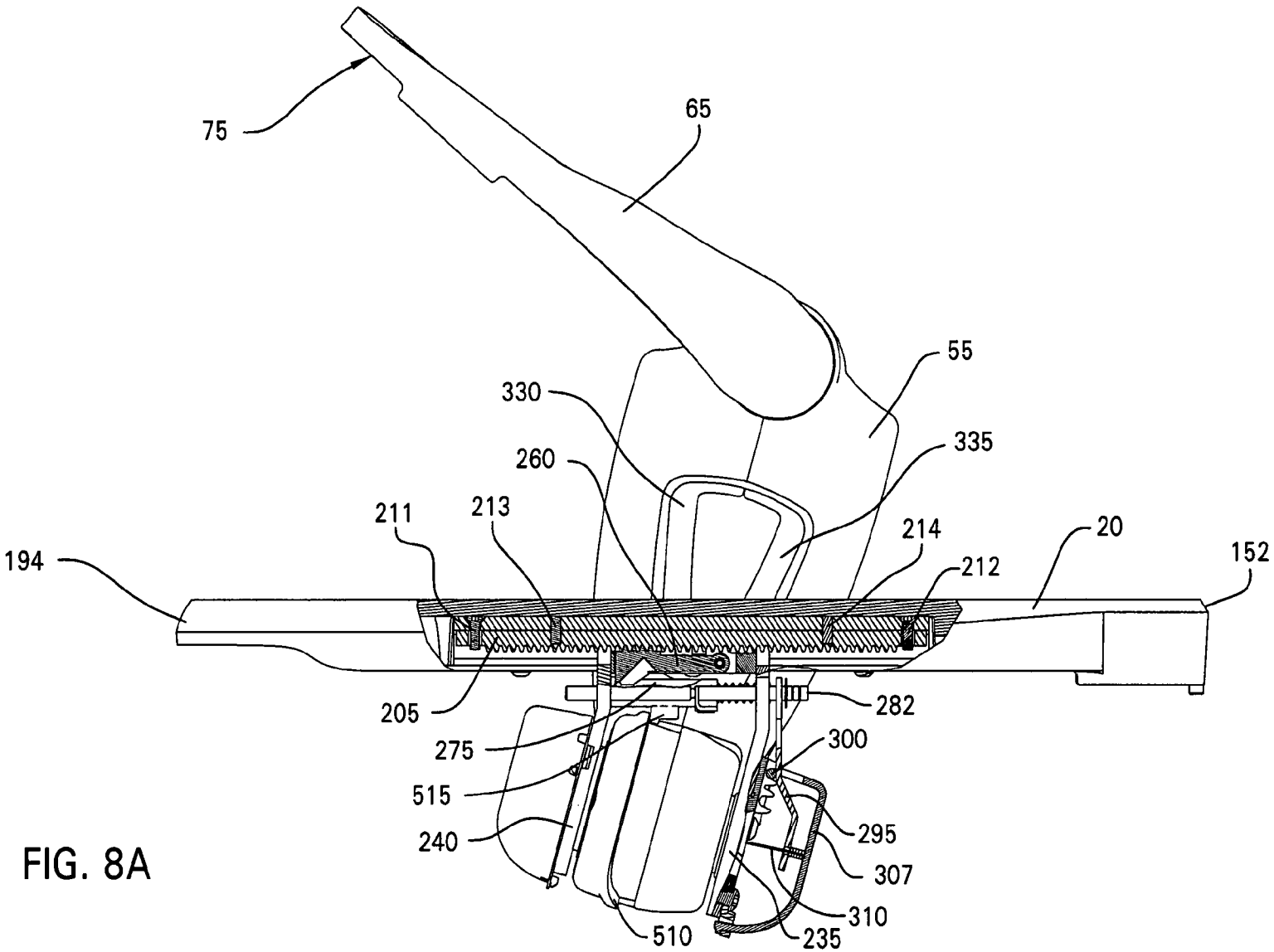
FIG. 8A is a partial cut-away side view of the foot support and abduction assembly according to FIGS. 1–7 in a locked position.
Figure 8B:
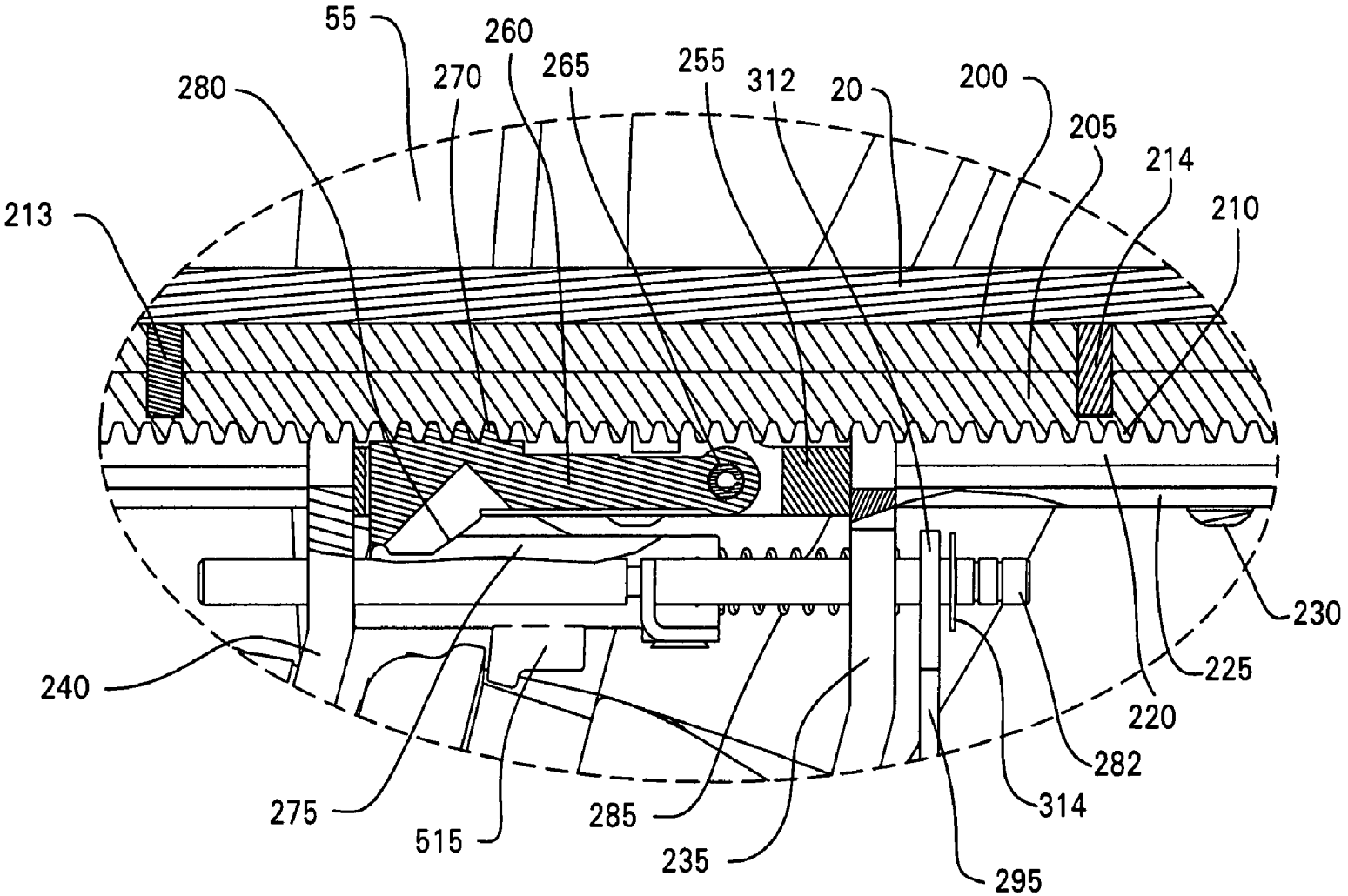
FIG. 8B is an enlarged detail view according to FIG. 8A.
Figure 12:
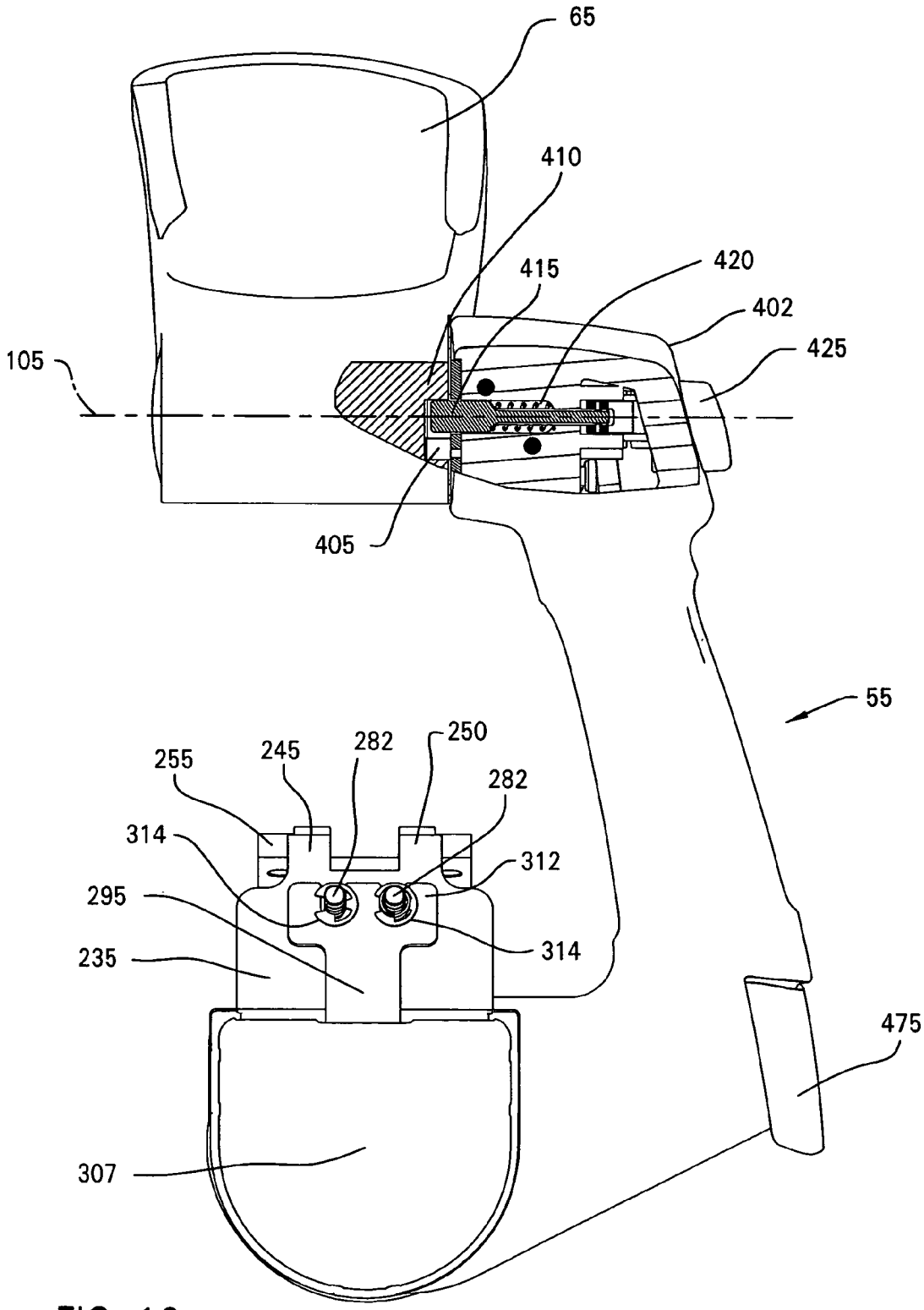
FIG. 12 is a partial cut-away end view of the upright assembly of FIGS. 10–11.

Referring to FIGS. 8A–8B, a partial cut-away view of the abductor 20 and upright assembly 55 is illustrated. The upright assembly 55 is slidably mounted to the abductor 20 and the rack assembly 200 by a pair of plates 235, 240. Plates 235, 240 include flanges 245, 250 (see FIG. 12) for straddling the rack 205. A mounting assembly 255 is fixed between the plates 235, 240 for engaging the tracks 215, 220 and the rack 205.

The mounting assembly 255 includes a locking arm 260 pivotally mounted by a pin 265 and including a plurality of teeth 270 configured for engaging the teeth 210 of the rack 205. The locking arm 260 is held upwardly and in engagement with the rack 205 by a cam wedge 275 having a locking projection 280. The cam wedge 275 is mounted on cam wedge rods 282 and is urged into a locked position of the locking arm 260 by a spring 285 bearing between the cam wedge 275 and the side plate 235.

Figure 9A:
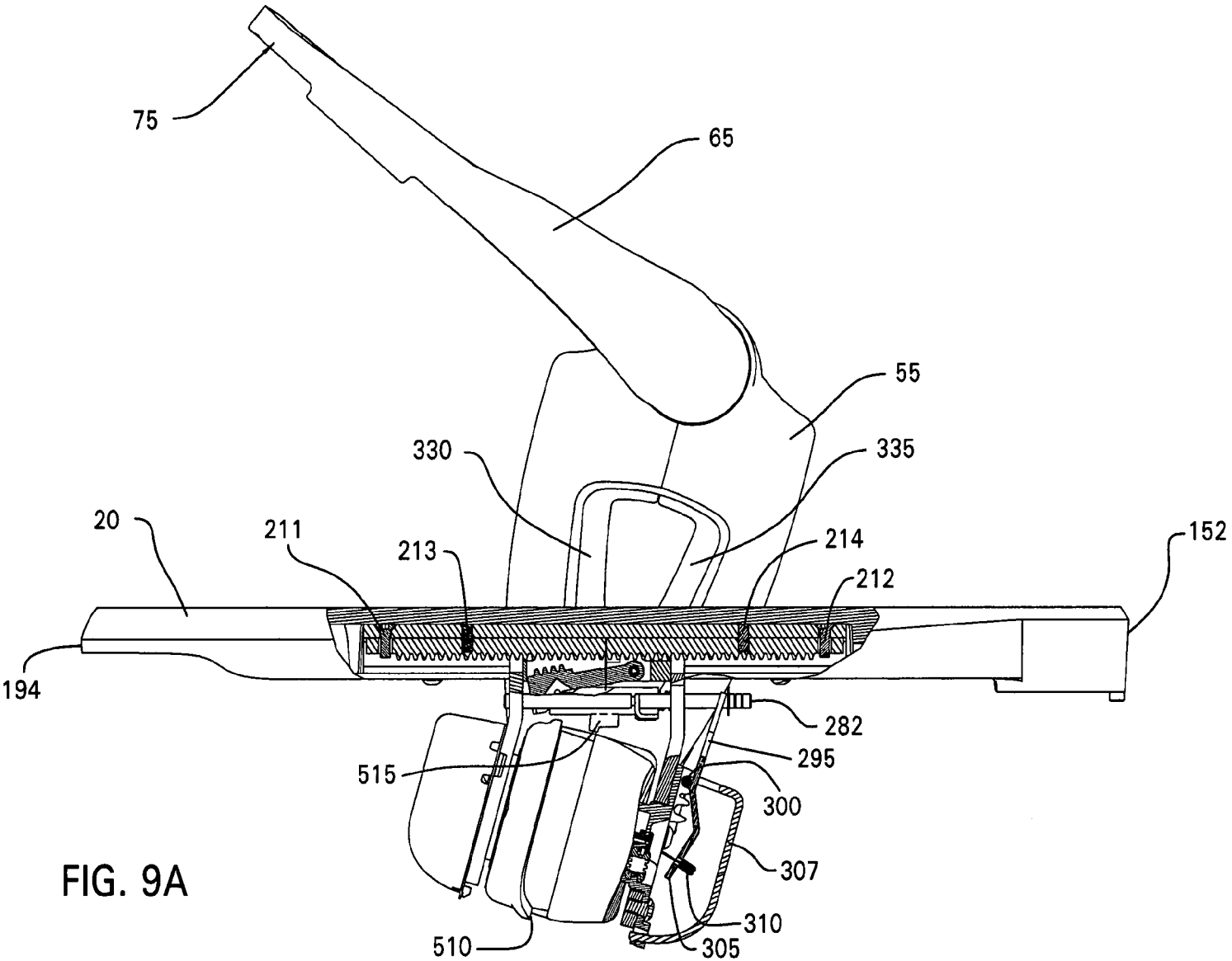
FIG. 9A is a partial cut-away side view of the foot support and abduction assembly of FIGS. 1–8 in an unlocked position.
Figure 9B:
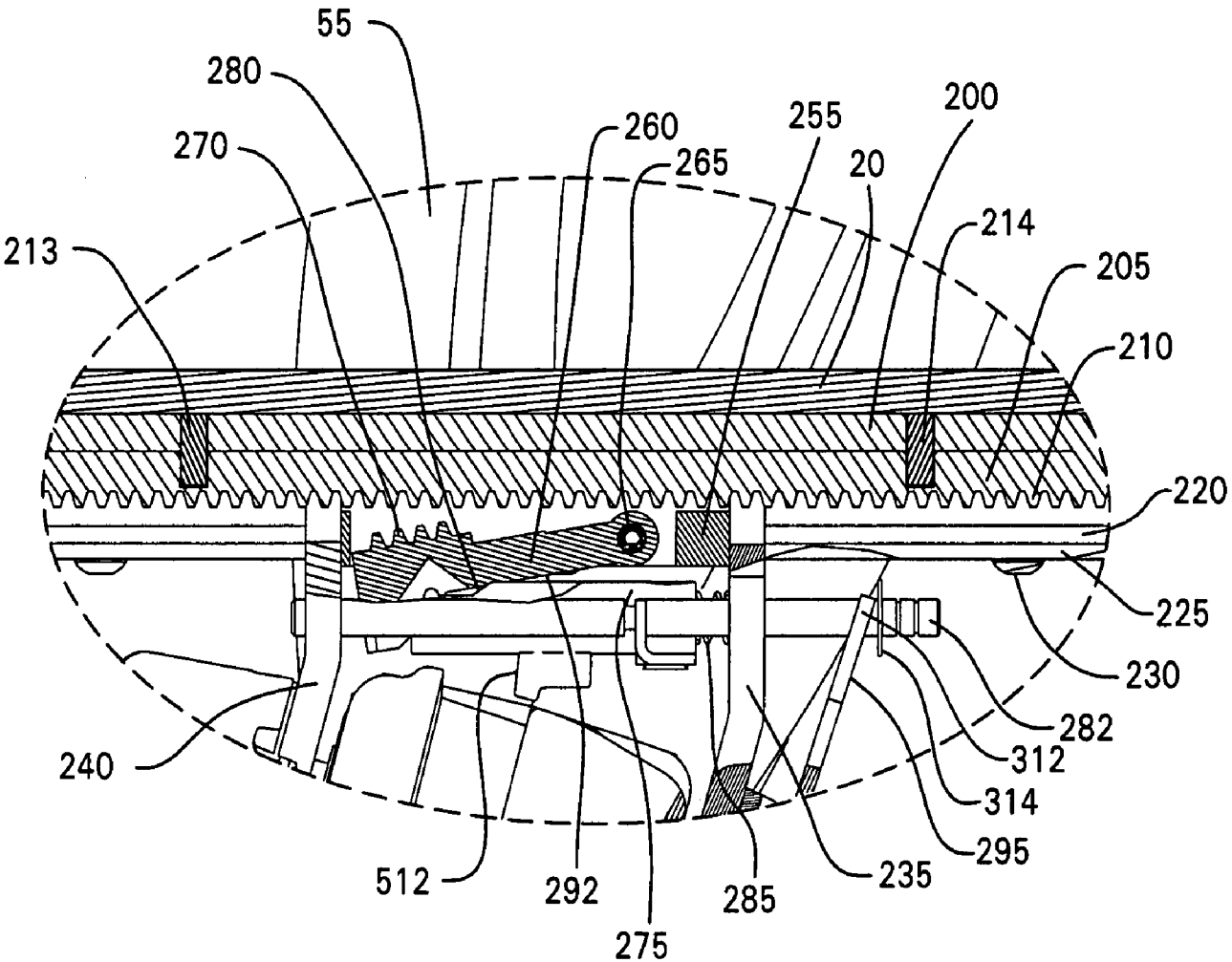
FIG. 9B is an enlarged detail view according to FIG. 9A.

Referring to FIGS. 9A–9B, to disengage the locking arm 260, the cam wedge 275 must be drawn to the right against the bias of the spring 285. As the cam wedge 275 is drawn to the right, the back surface 292 of the locking arm 260 rides down the canted upper surface 280 of the cam wedge 275, permitting the locking arm 260 to disengage from the rack 205. The cam wedge rods 282 are drawn to the right against the bias of spring 285 by a lever arm 295 pivoting about a pin 300. A distal end 305 of the lever arm 295, concealed within housing 307, is engaged by a cable 310 for drawing the distal end 305 to the left and pivoting the lever arm 295 about the pin 300. A proximal end 312 of the lever arm 295 is shifted to the right and bears against snap rings 314, drawing the cam wedge rods 282 and the cam wedge 275 to the right. With the locking arm 260 disengaged from the rack 205, the upright assembly 55 is free to translate longitudinally on the abductor 20.

Figure 10:
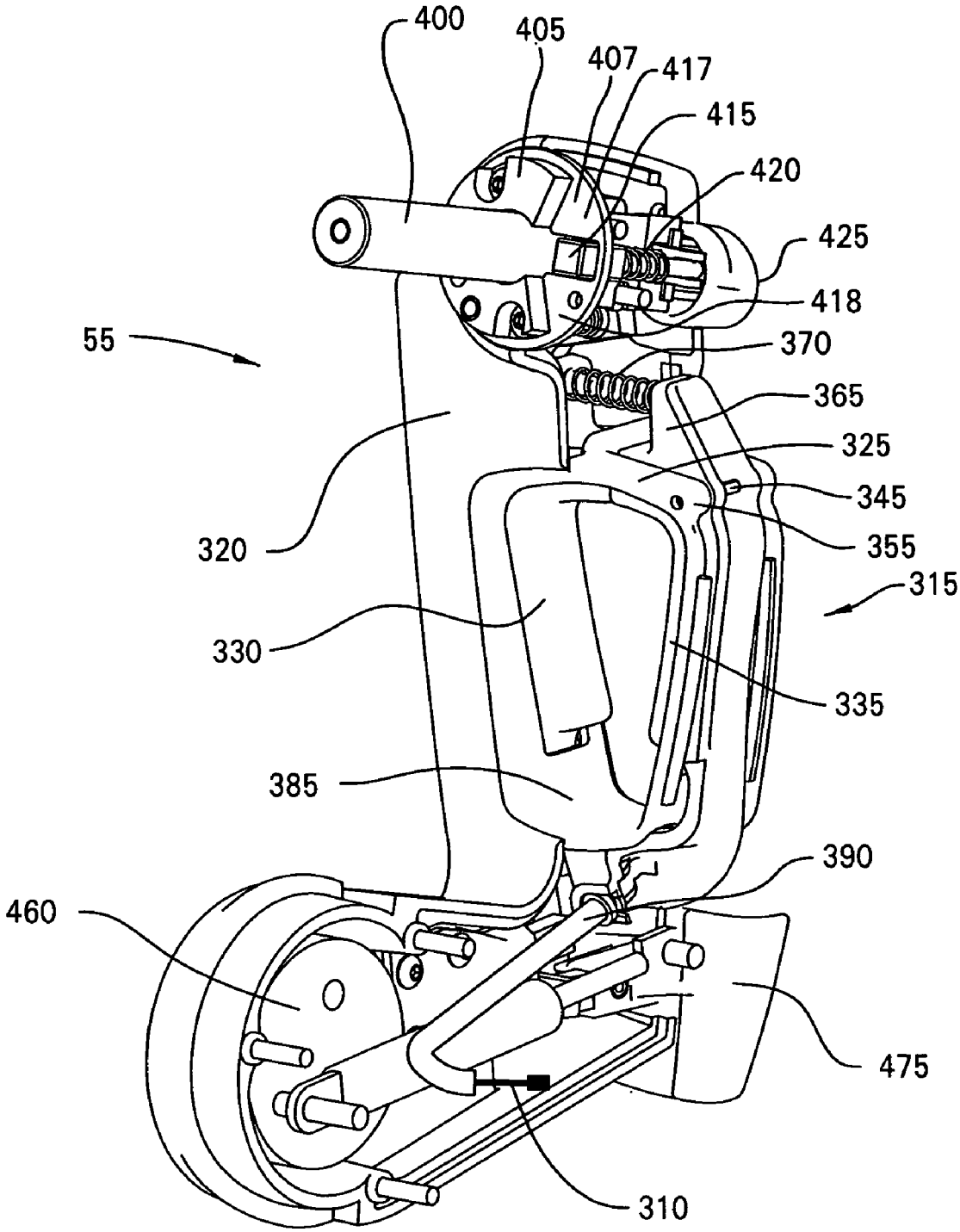
FIG. 10 is a partial cut-away perspective view of an upright assembly for the foot support of FIGS. 1–9.
Figure 11:
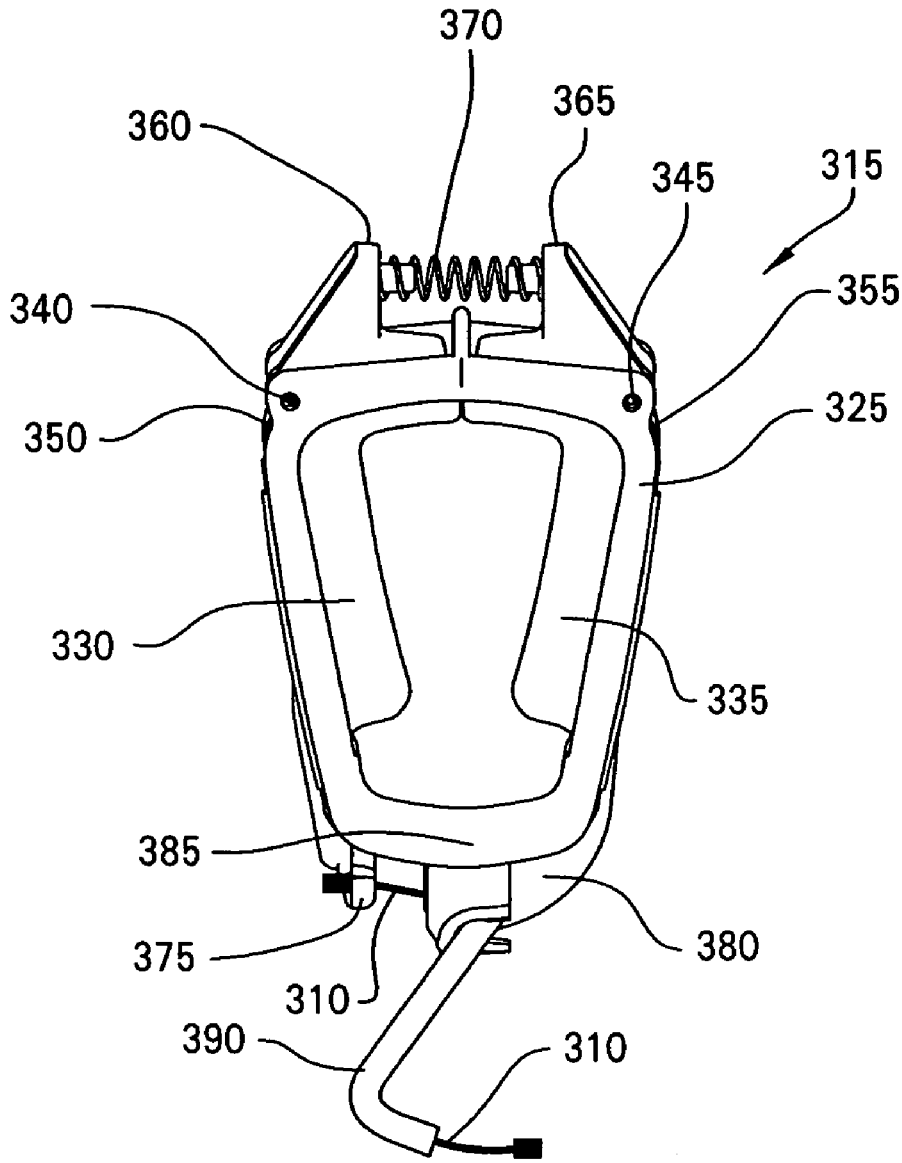
FIG. 11 is a partial cut-away side view of a handle of the upright assembly of FIG. 10.

Referring now to FIGS. 10–11, the cable 310 is actuated by a handle assembly 315 received in the housing 320 of the upright assembly 55. The handle assembly 315 includes an oblong frame 325 having a first handle 330 and a second handle 335 each pivotally attached by a pin 340, 345 to a respective upper corner 350, 355 of the oblong frame 325. Upper lever portions 360, 365 of the first and second handles 330, 335 are urged apart by a compression spring 370. This urges a lower lever portion 375 of the first handle 330 and a lower lever portion 380 of the second handle 335 together at a lower extent 385 of the frame 325. An end of the cable 310 is secured to the lower lever portion 375 of the first handle 330 and a sheath 390 of the cable 310 is affixed to the lower lever portion 380 of the second handle 335. As an operator squeezes either the first handle 330 or the second handle 335, the separation distance between the lower lever portion 375 of the first handle 330 and the lower lever portion 380 of the second handle 335 increases, forcing the cable 310 to be retracted within the sheath 390. As a consequence, the distal end 305 of the lever arm 295 is drawn in by the cable 310, thereby releasing the lock arm 260 to permit the longitudinal translation of the upright assembly 55 on the abductor 20.

Referring now to FIGS. 12–19, the foot support 65 is pivotally mounted on a pivot shaft 400 about the pivot axis 105 to an upper extent 402 of the upright assembly 55. The upright assembly 55 includes a projecting wedge portion 405 (See also FIG. 10) surrounding pivot shaft 400, and a corresponding gap portion 407. The foot support 65 includes a wedge portion 410 complementary to the wedge portion 405 for allowing a restricted rotation of the foot support 65 about the pivot shaft 400. The upright assembly further includes a foot support locking pin 415 extending into the region about the wedges 405, 410 and configured for locking the wedge 410 in one of two distinct positions.

Figure 13:
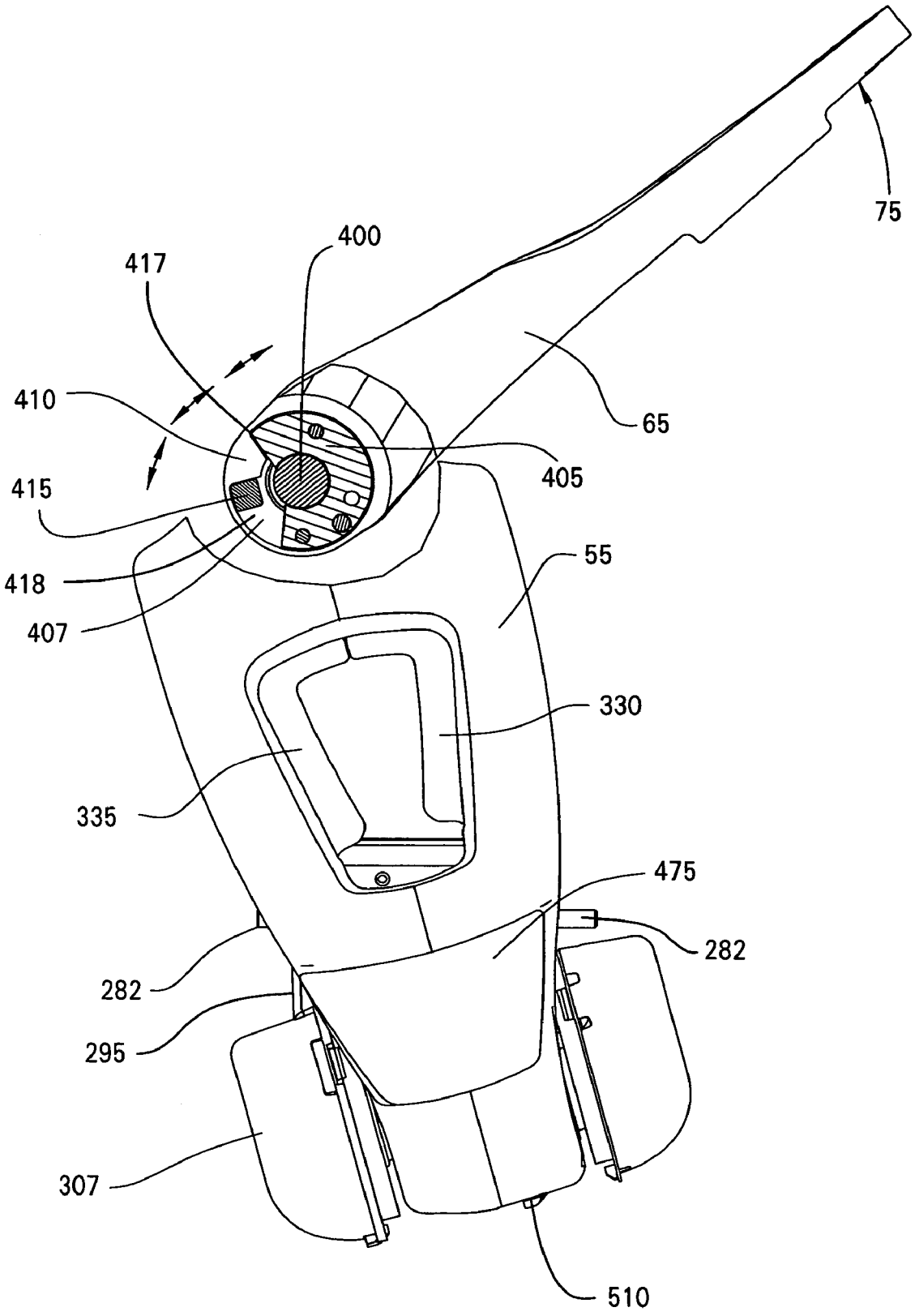
FIG. 13 is a partial cut-away side view of the upright assembly of FIGS. 10–12.
Figure 15:
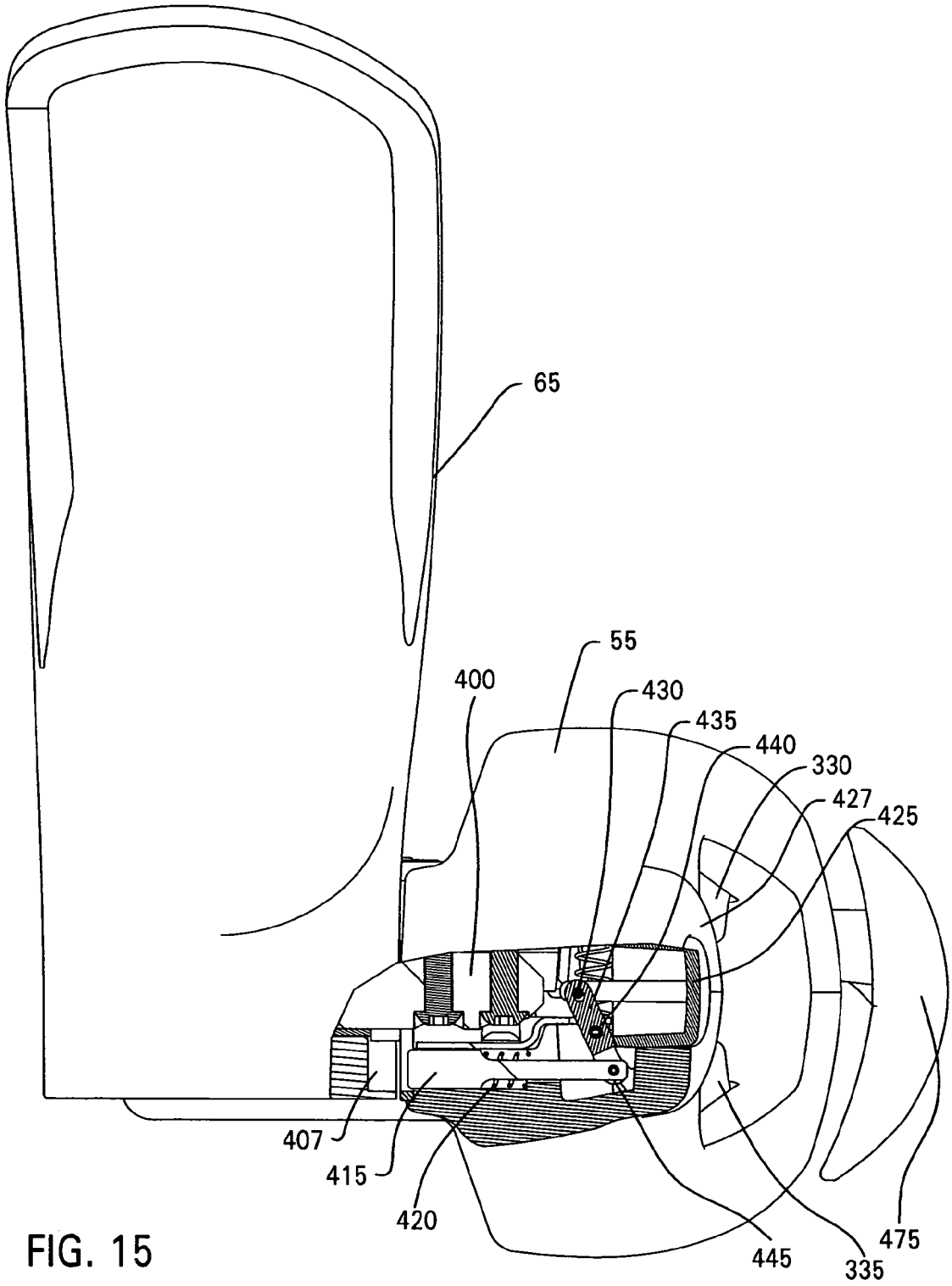
FIG. 15 is a partial cut-away plan view of the upright assembly of FIGS. 10–14 with the foot support in an unlocked position.
Figure 16:
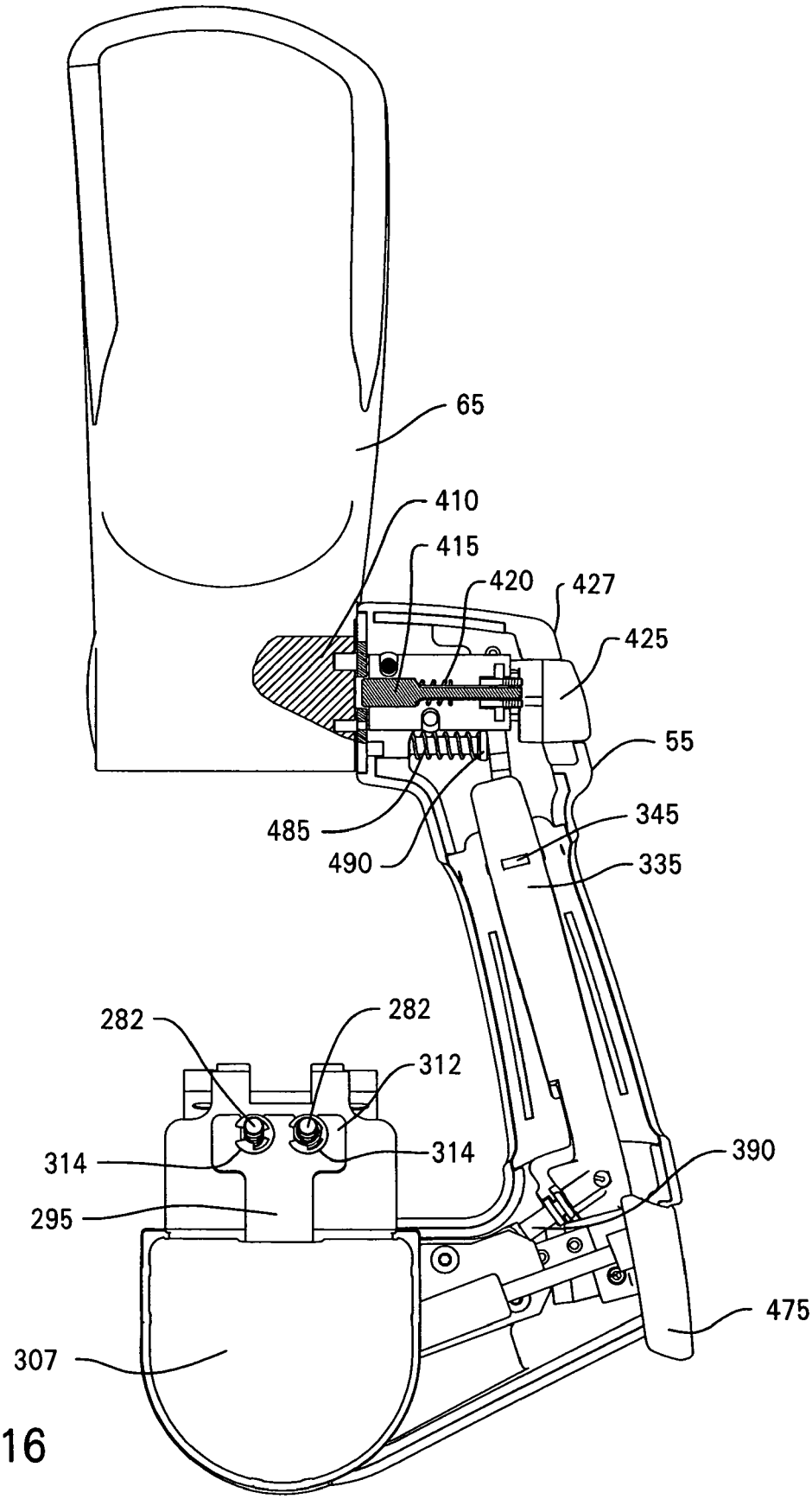
FIG. 16 is a partial cut-away end view of the upright assembly according to FIG. 15.
Figure 17:
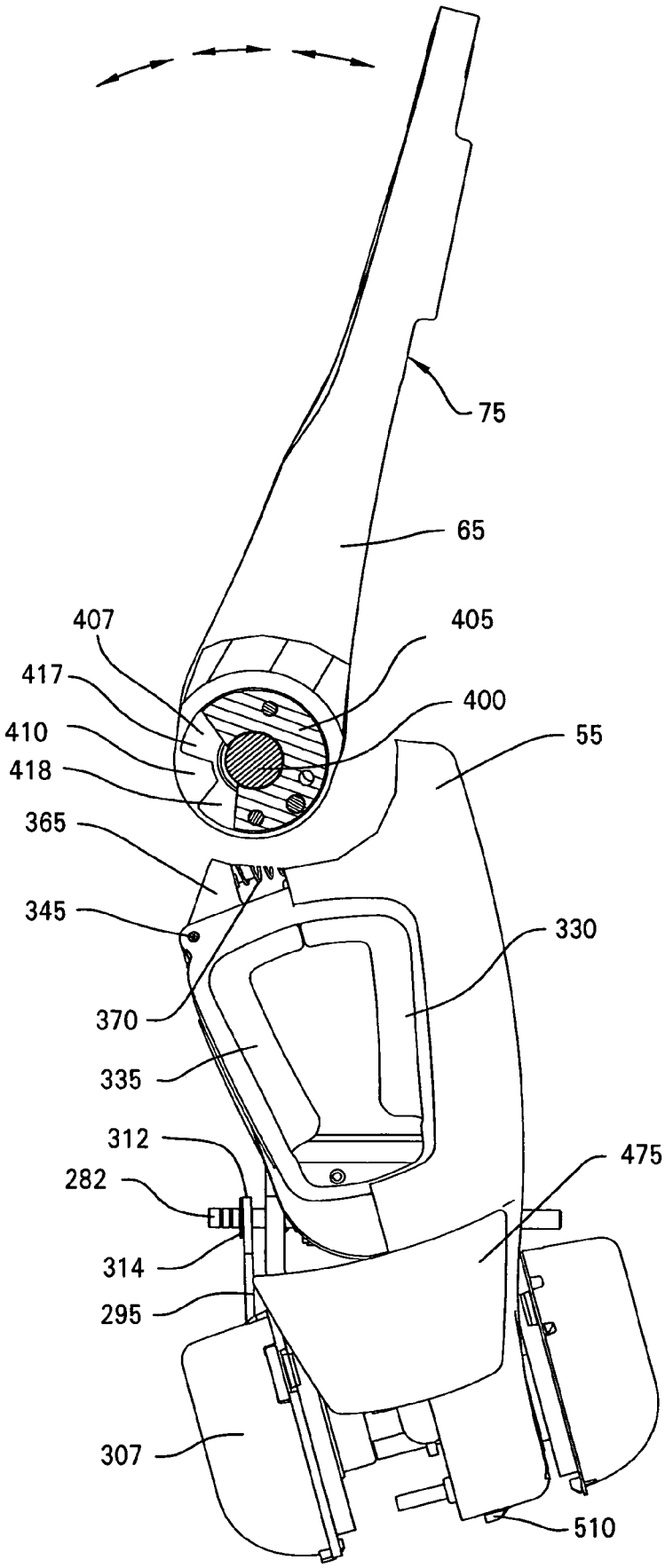
FIG. 17 is a partial cut-away side view of the upright assembly according to FIGS. 15–16.
Figure 18:
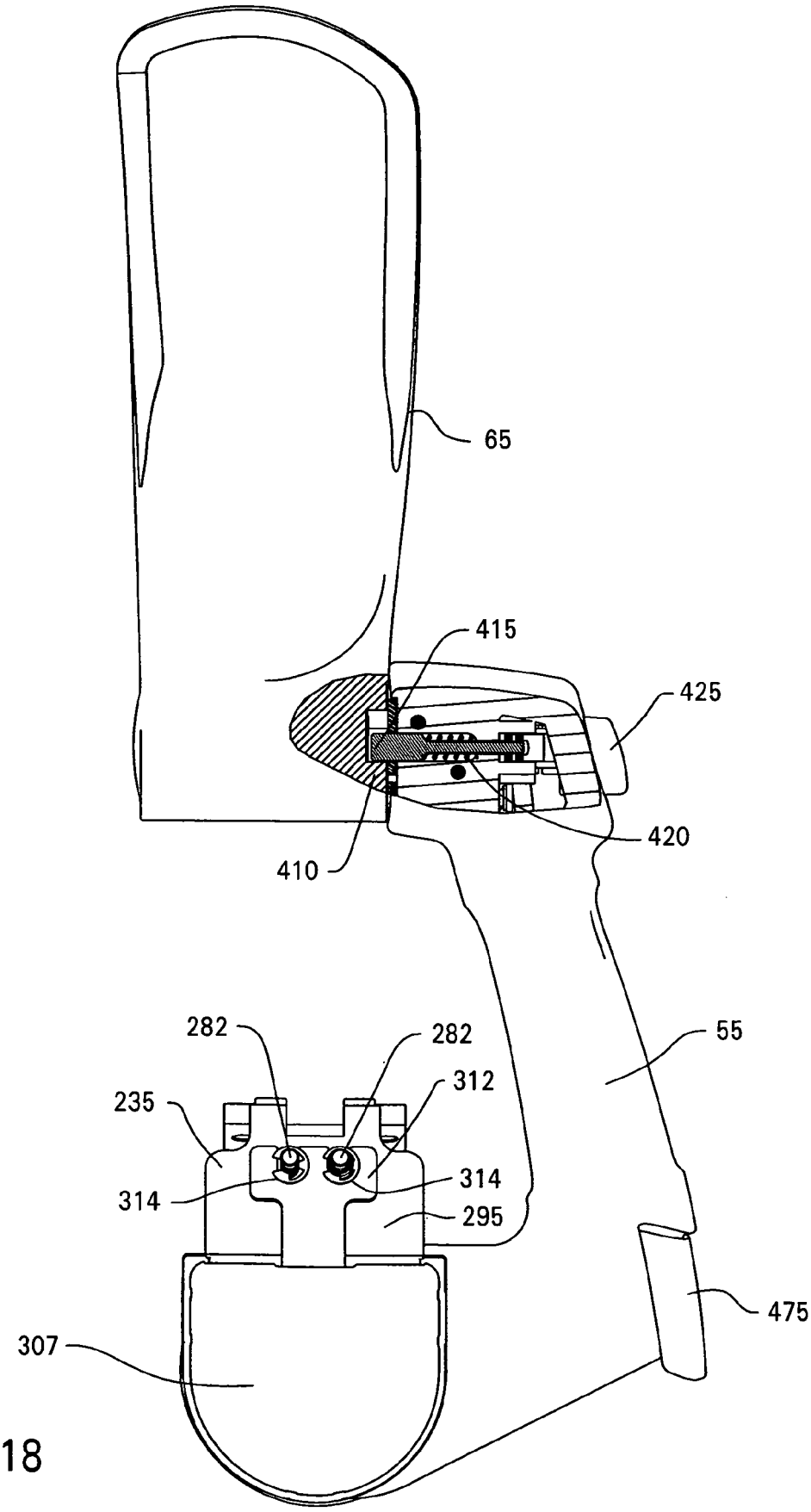
FIG. 18 is a partial cut-away end view of the upright assembly of FIGS. 10–17 with the foot support in a second deployed position.
Figure 19:
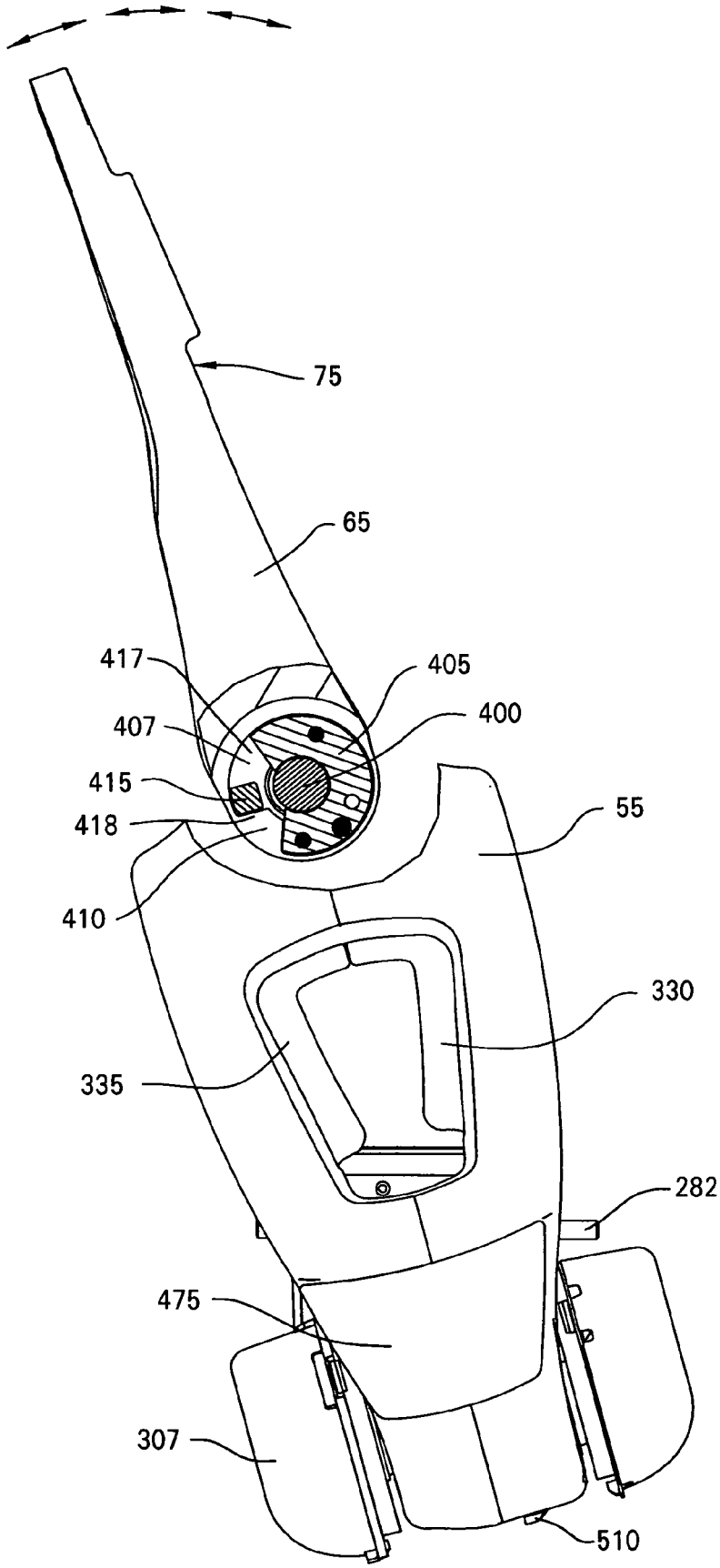
FIG. 19 is a partial cut-away side view according to FIG. 18.

In FIG. 13, the foot support 65 is locked in a foot-support-use position with the wedge portion 410 trapped in an upper extent 417 of the gap portion 407 between the wedge portion 405 and the locking pin 415. As shown in FIGS. 15–17, the pin 415 is retracted allowing the wedge 410 of the foot support to travel freely in the gap portion 407 around the wedge 405. As shown in FIG. 19, the wedge 410 is locked in a lower extent 418 of the gap portion 407 around wedge 405 by the extended foot support locking pin 415. The locking pin 415 is urged into the extended position by a spring 420. The locking pin 415 is retracted by an operator depressing a push button 425 positioned on an outer face 427 of the upright assembly 55.

Figure 14:
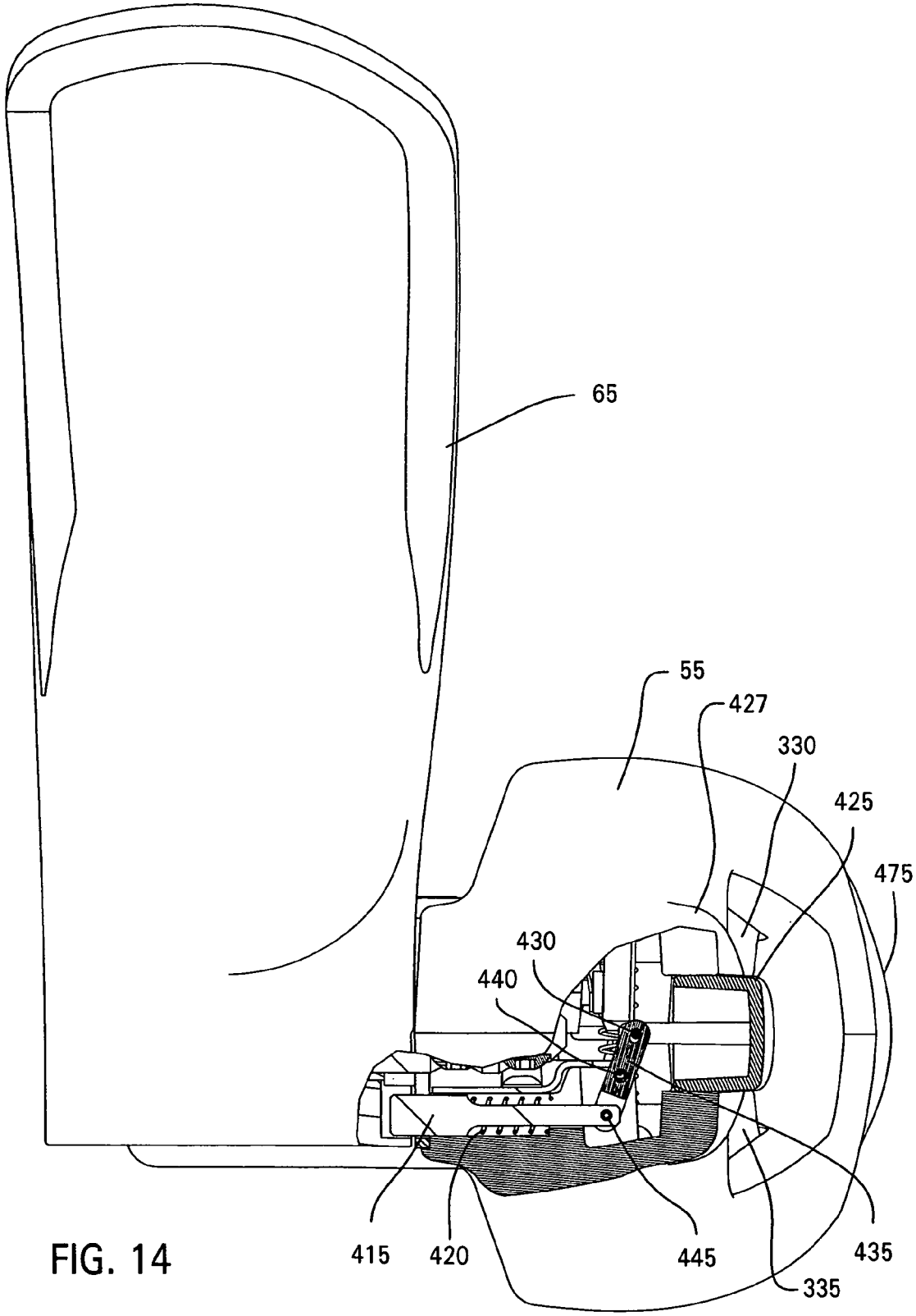
FIG. 14 is a partial cut-away plan view of the upright assembly of FIGS. 10–13 with the foot support in a locked position.

The push button 425 is pivotally connected to a first end 430 of a toggle link 435 that is pivotally mounted in the upright assembly 55 by a pivot pin 440. A second end 445 of the toggle link is pivotally connected to an end of the locking pin 415. As best illustrated in FIGS. 14–15, depressing the push button 425 forces the pin 415 to retract from engagement with the wedges 405, 410, thereby freeing the foot support 65 to rotate about the pivot axis 105.

Figure 20:
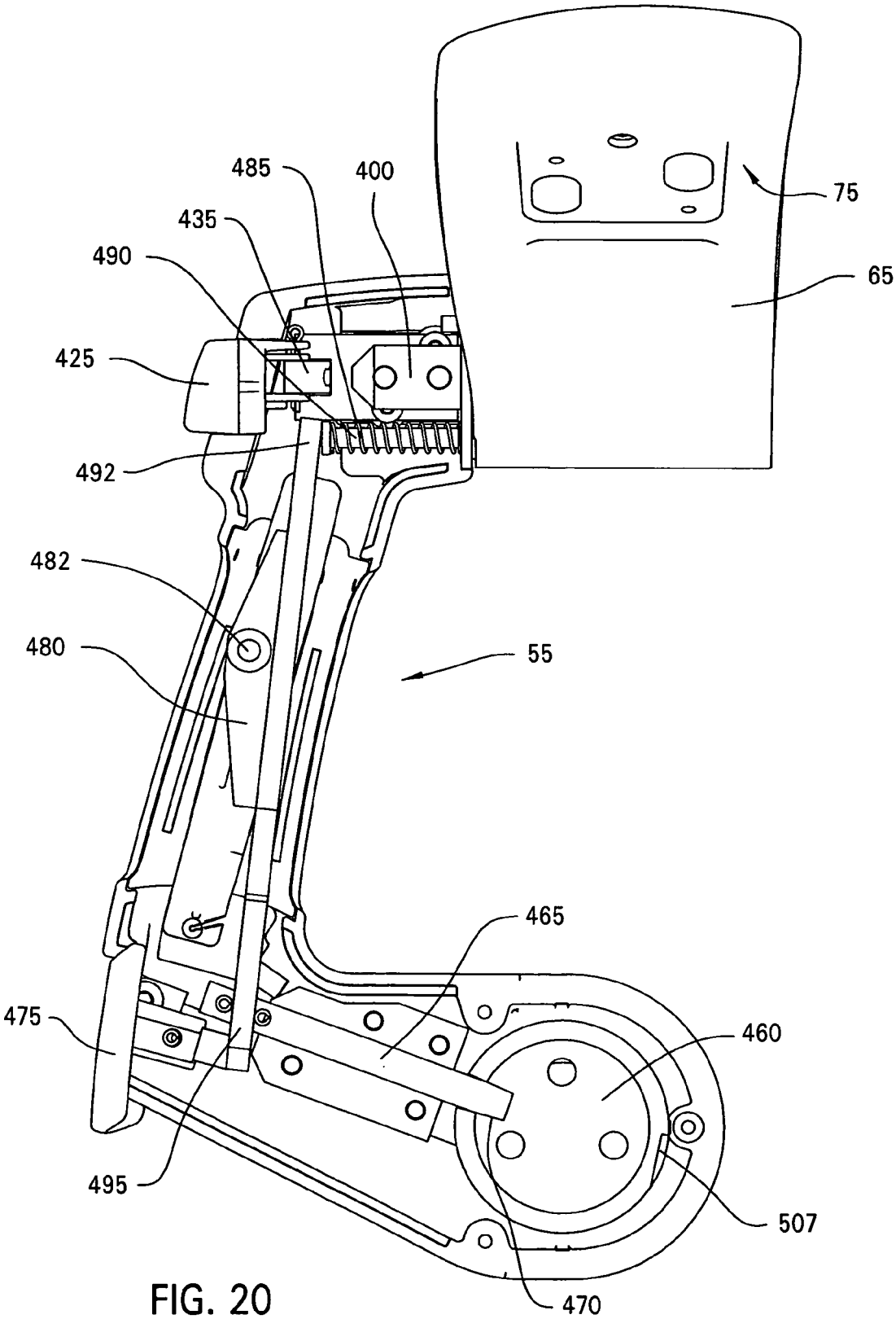
FIG. 20 is a partial cut-away end view of the upright assembly according to FIGS. 10–19 with the upright assembly in a locked position.
Figure 21:
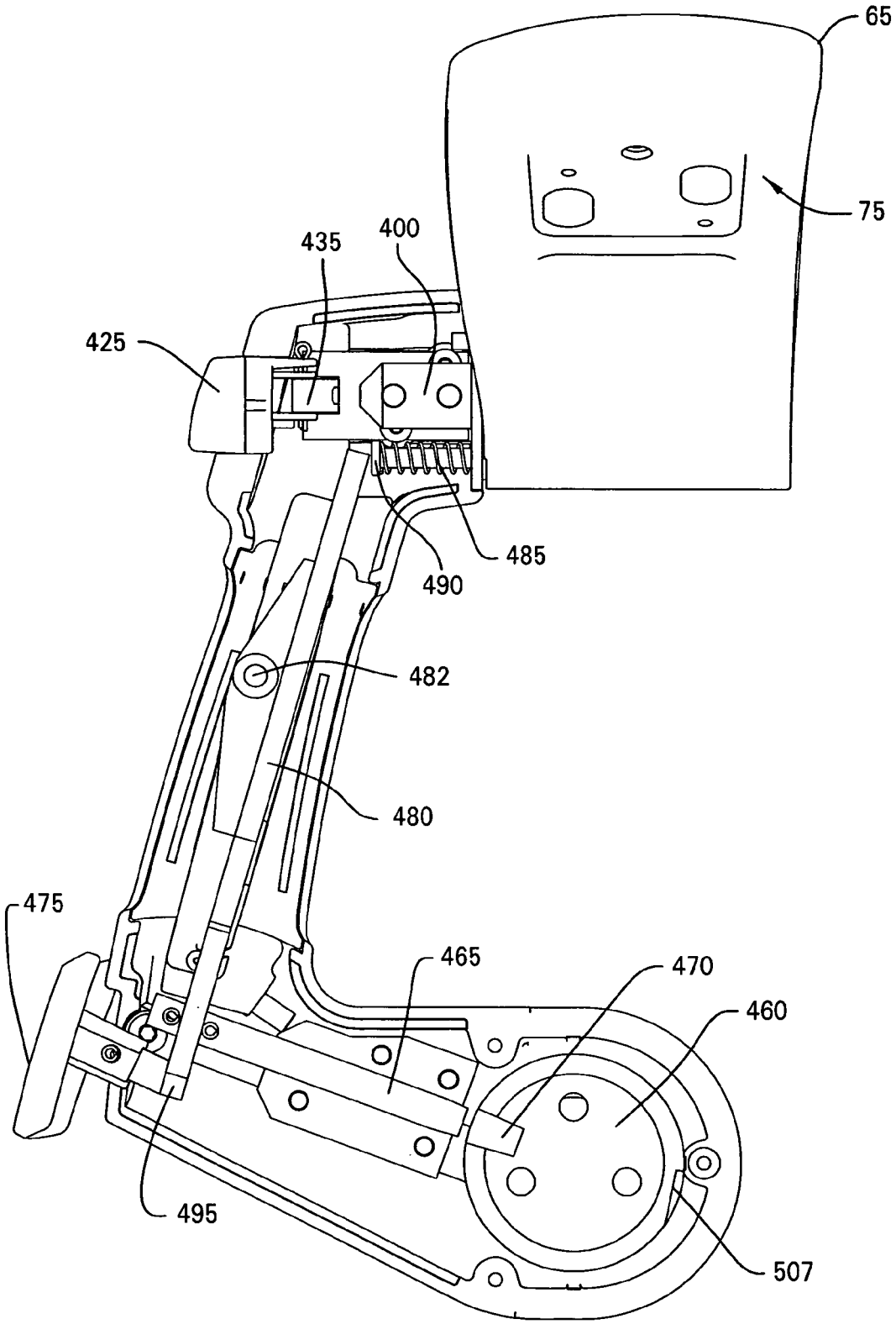
FIG. 21 is a partial cut-away end view of the upright assembly according to FIGS. 10–20 with the upright assembly in an unlocked position.
Figure 22:
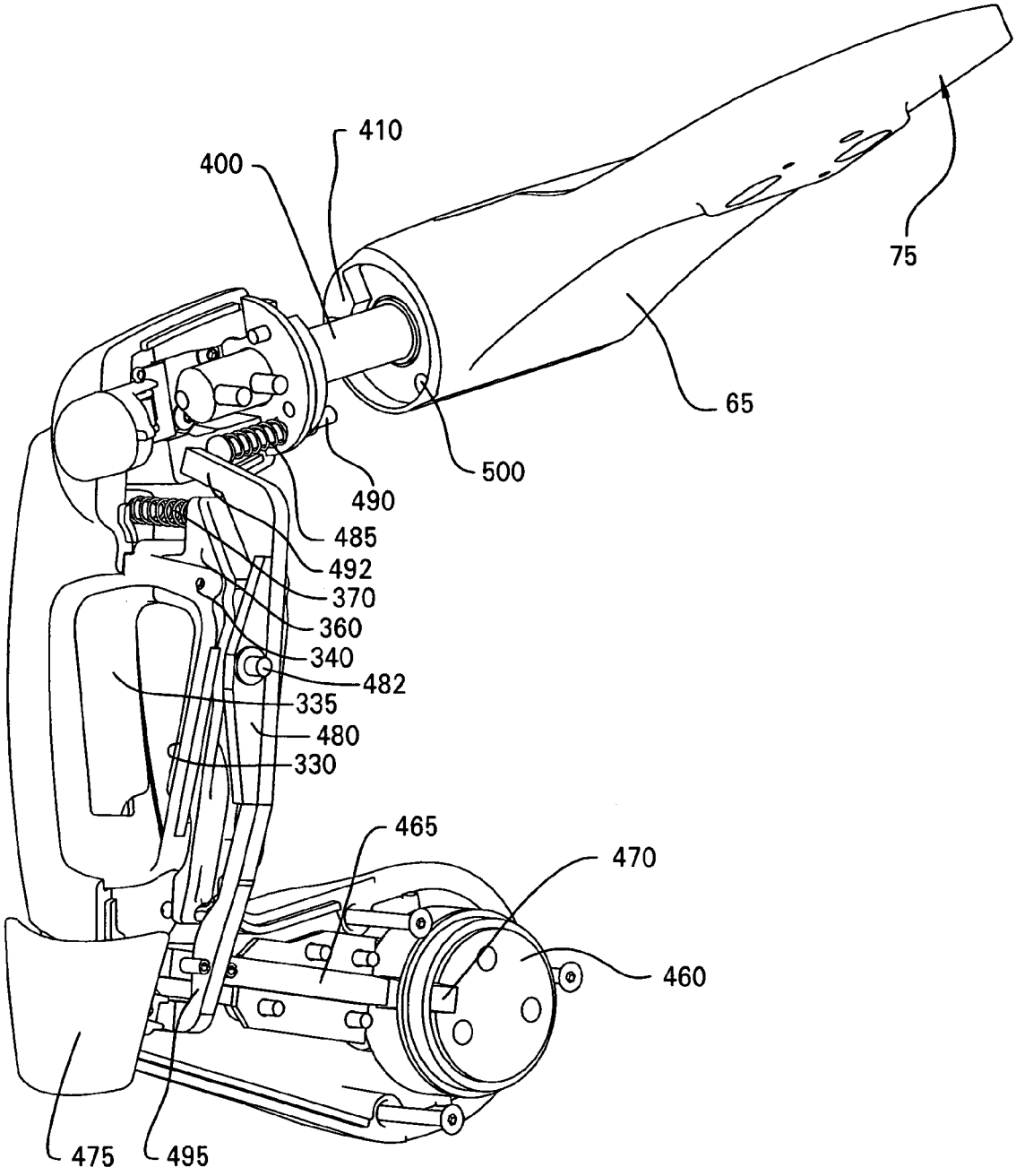
FIG. 22 is a partial cut-away perspective view of the upright assembly according to FIG. 21.

Referring now to FIGS. 20–22, the upright assembly 55 is pivotally mounted to a hub 460 affixed to the side plates 235, 240. The upright assembly 55 is maintained in an upright position by a pin 465 slidably mounted in the upright assembly 55 being received in an aperture 470 of the hub 460. The pin 465 is retractable from the aperture 470 of the hub 460 by operation of a stow-lever handle 475 and stow link 480. The stow link 480 is urged in a counterclockwise direction about a pivot pin 482 by a spring 485 mounted on a foot rotation pin 490 urging an upper end 492 of the stow link 480 to the left. A lower end 495 of the stow link 480 thereby urges the pin 465 into the aperture 470 of the hub 460. The pin 465 is drawn from the aperture 470 by an operator pulling on the stow-lever handle 475 to shift the lower end 495 of the stow link 480 to the left.

In order for the stow lever handle 475 to draw the stow link 480 in a clockwise direction against the urging of the spring 485, the foot rotation pin 490 must be translated to the right. As shown in FIG. 22, the foot support 65 must be in a position wherein a foot rotation pin aperture 500 is in alignment with the foot rotation pin 490. The position of the foot support 65, hereinafter referred to as the stow position, is the forward position wherein the foot support 65 is accessible by the patient. With the foot rotation pin 490 in alignment with the aperture 500, the stow link 480 can rotate about the pivot pin 482, urging the foot rotation pin 490 into the aperture 500. The lower end 495 of the stow link 480 draws the pin 465 out of the aperture 470 of the hub 460. With the pin 465 extracted from the aperture 470, the upright assembly 55 is free to rotate about the hub 460. As the upright assembly 55 is rotated, the operator will release the handle 475 so that pin 465, under the urging of the spring 485, will bear against the surface of the hub 460. As the upright assembly 55 rotates approximately 180 degrees, the pin 465 will engage a recessed stop/detent 507 in the surface of the hub 460. The stop/detent 507 prevents the upright assembly 55 from over-rotating, and further resists inadvertent rotation of the upright assembly 55 toward the deployed position.

Figure 23:
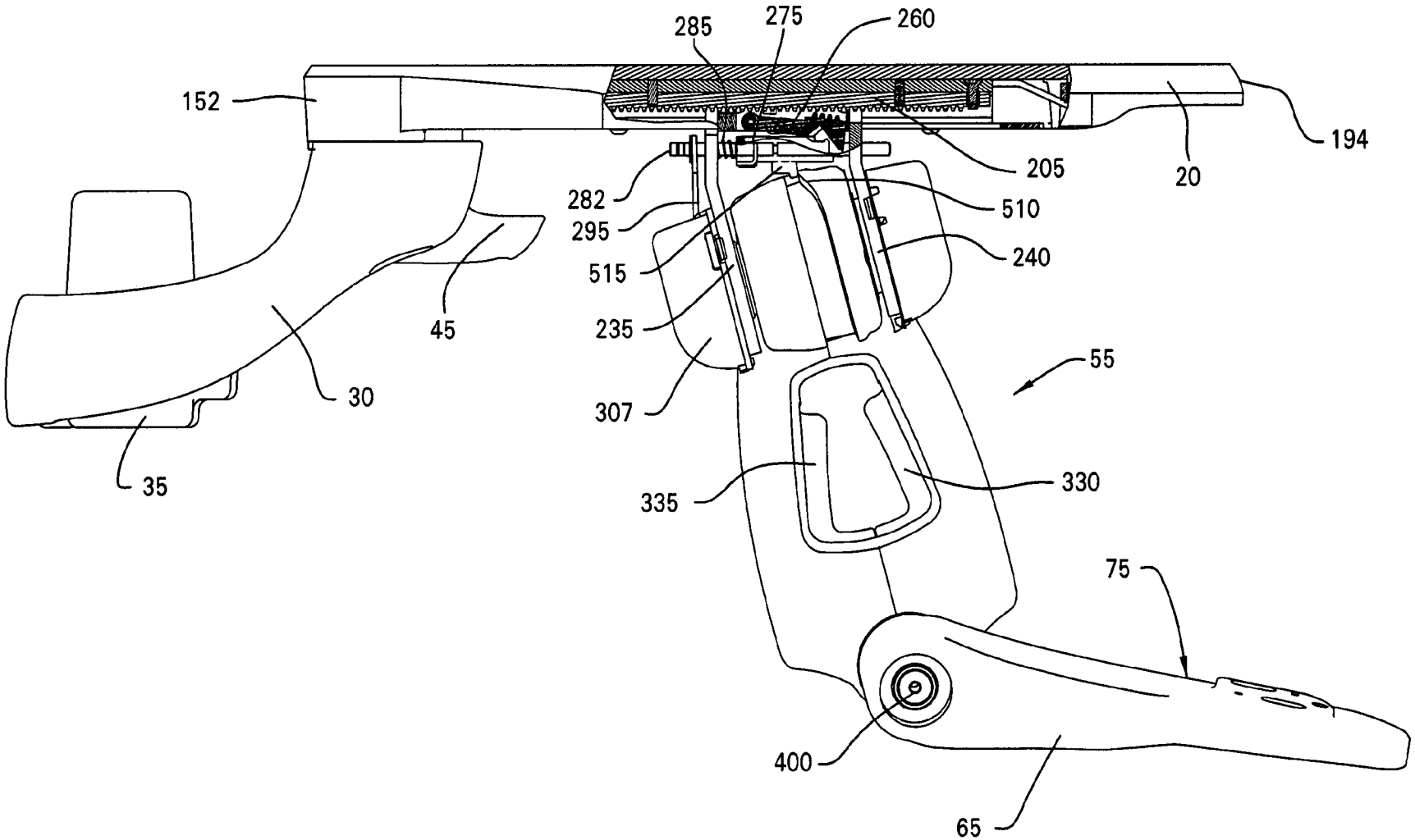
FIG. 23 is a partial cut-away side view of the abduction assembly of FIGS. 1–22 with the upright assembly in a stowed position.
Figure 24:
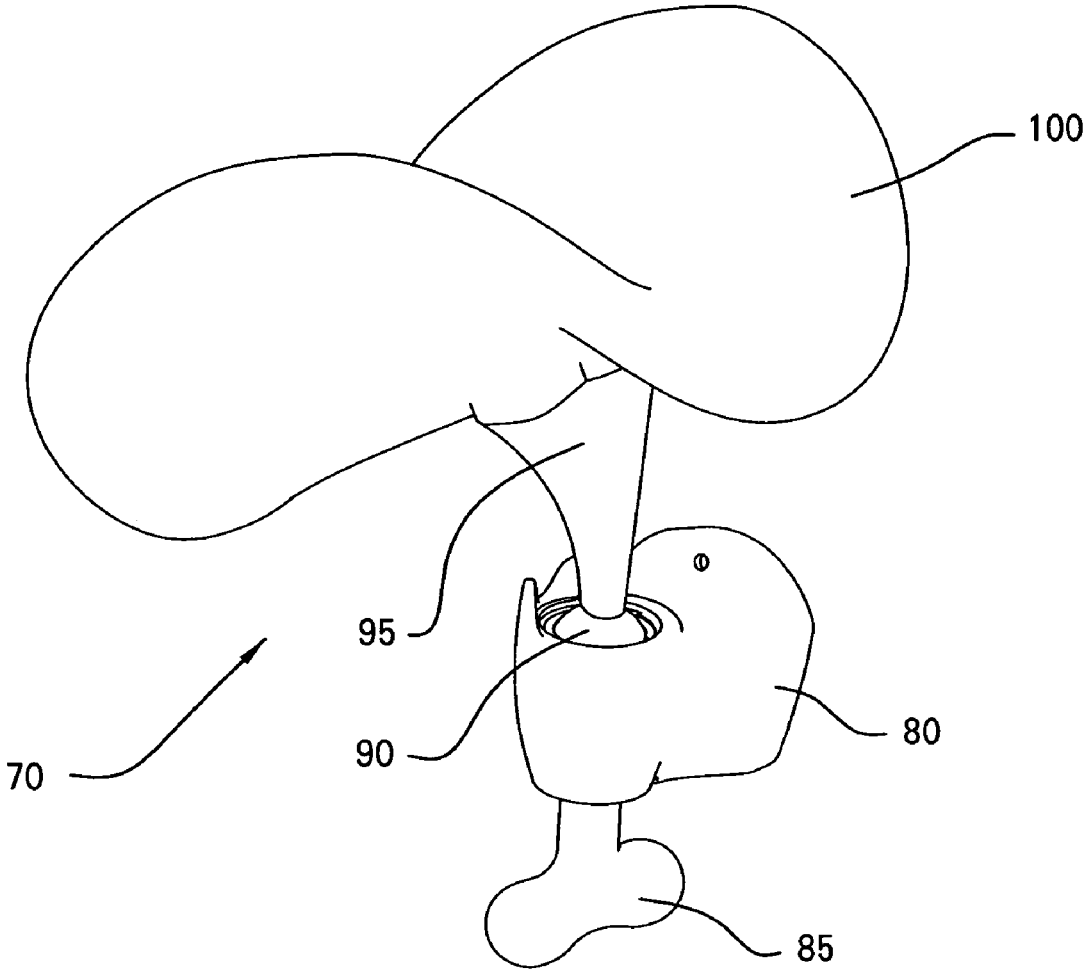
FIG. 24 is a perspective view of a calf support for attachment to the foot support of FIGS. 1–23.
Figure 25:
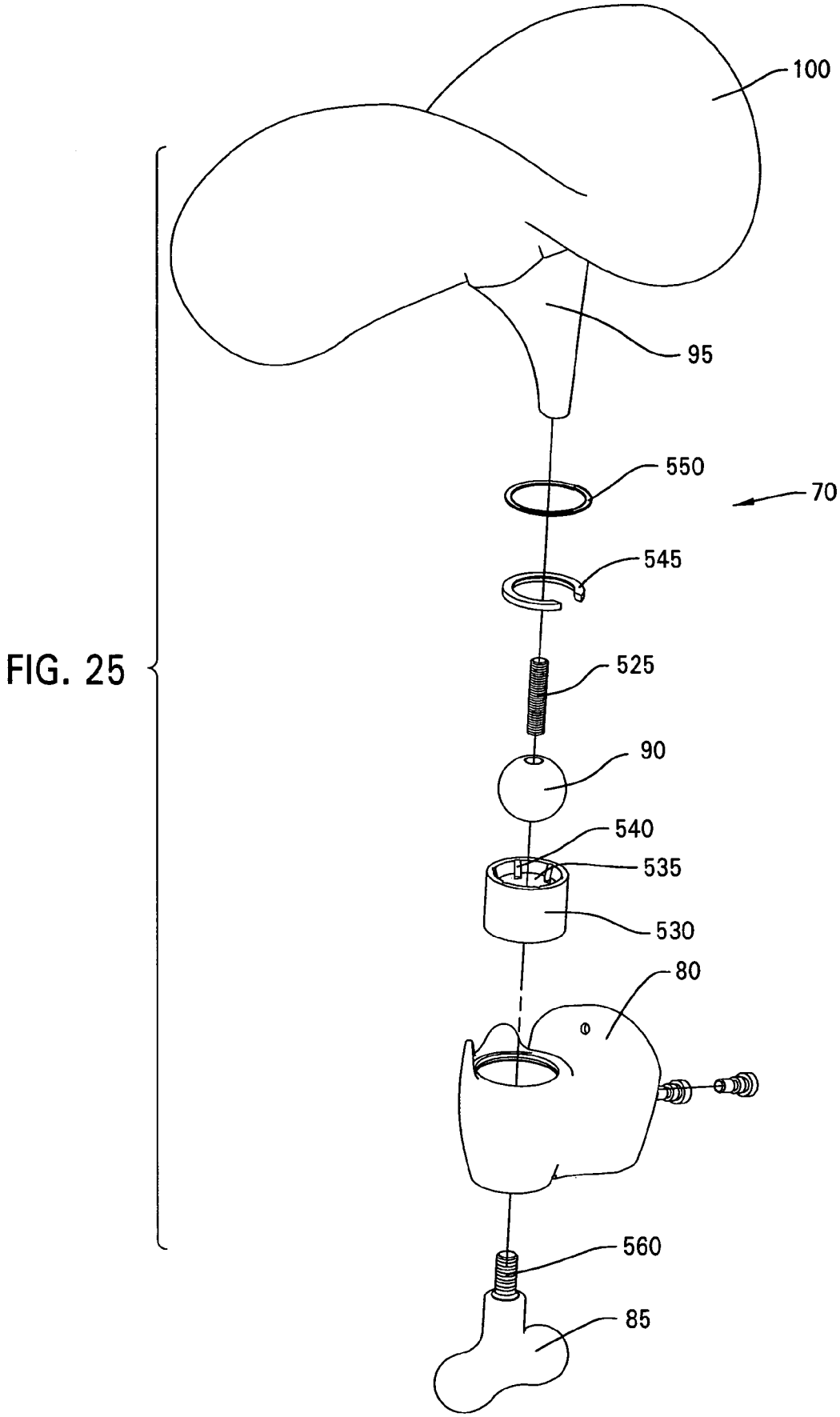
FIG. 25 is an exploded perspective view of the calf support of FIG. 24.

Referring to FIG. 23, the upright assembly 55 is rotated to a stowed position underneath the abductor 20. As the upright assembly 55 is rotated to the stowed position of FIG. 23, a cam feature 510 of the upright assembly 55 acts against a tab 515 projecting from the cam wedge 275. As the upright assembly 55 is rotated to the stowed position, the cam feature 510 rides against the tab 515 on the cam wedge 275 and forces the cam wedge 275 against the bias of the spring 285, allowing the locking arm 260 to disengage from the rack 205. The upright assembly 55 is thereby released for longitudinal movement on the rack 205 automatically when the upright assembly 55 is placed in the stowed position underneath the abductor 20.

The calf support assembly 70 is illustrated in FIGS. 24–27. The calf support 100 is constructed of a thermo-formed insert 101 and a urethane foam over-molded cover 102. The insert 101 is secured to the stanchion 95 by a plate 103 and fastener 104. This assembly is then placed in a mold for application of the urethane foam over-molded cover 102. The cover 102 is sealed against fluids and formulated for compatibility with cleaning solutions. The stanchion 95 of the calf support 100 is secured to the phenolic ball 90 by a threaded rod 525. A sleeve 530 is slidably received in the calf support housing 80. The sleeve 530 includes a cup 535 having machined grooves 540 therein. The phenolic ball 90 is then received in the cup 535 of the sleeve 530 within the housing 80. A locking ring 545 is then placed over the phenolic ball 90 and a retaining ring 530 is inserted into a groove 555 in the housing 80 to retain the assembly in the housing 80. The handle 85 includes a threaded portion 560 that is received in a threaded aperture 565 of the housing 80.

Figure 26:
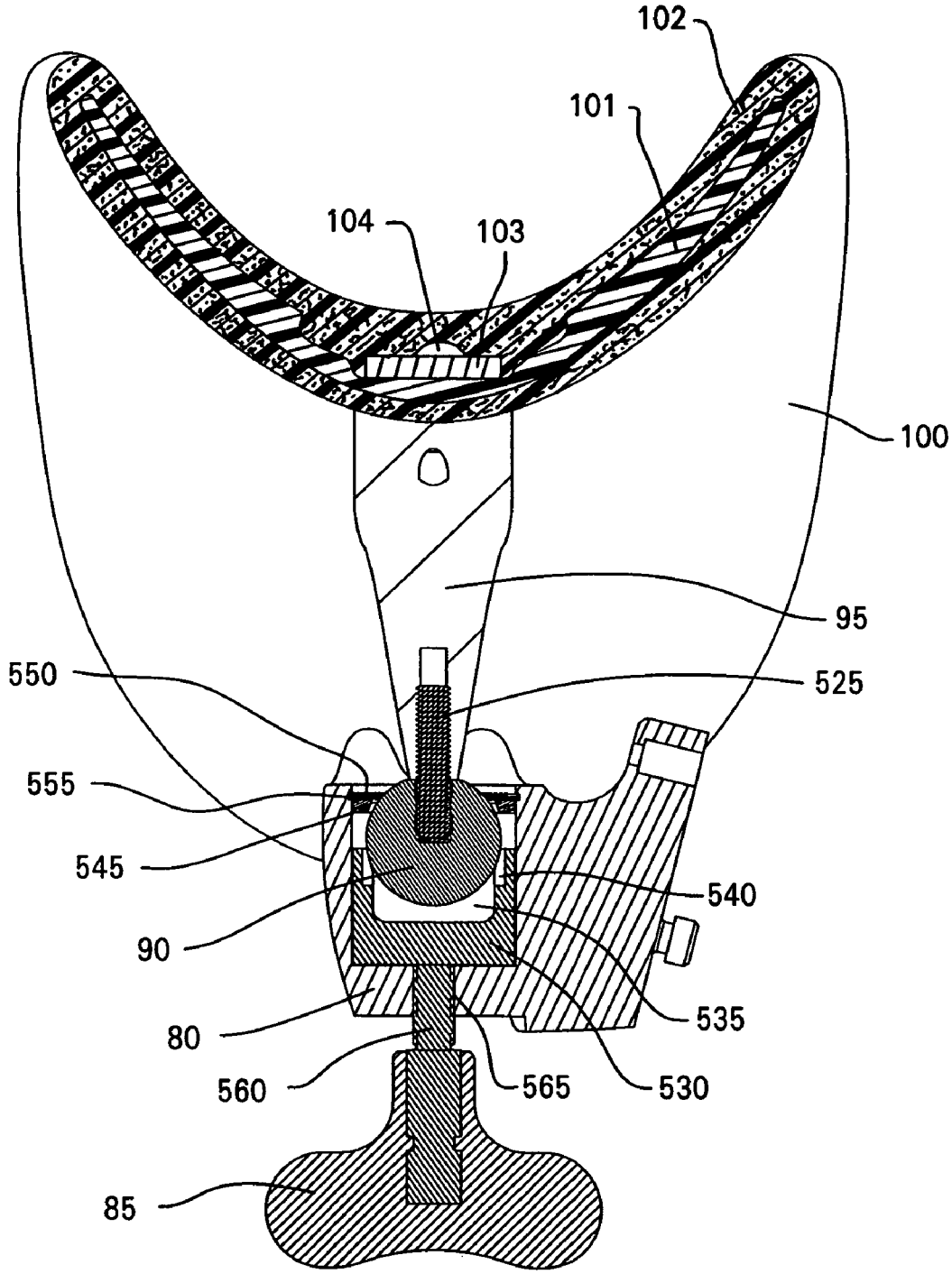
FIG. 26 is a partial cut-away end view of the calf support of FIGS. 24–25 in an unlocked position.
Figure 27:
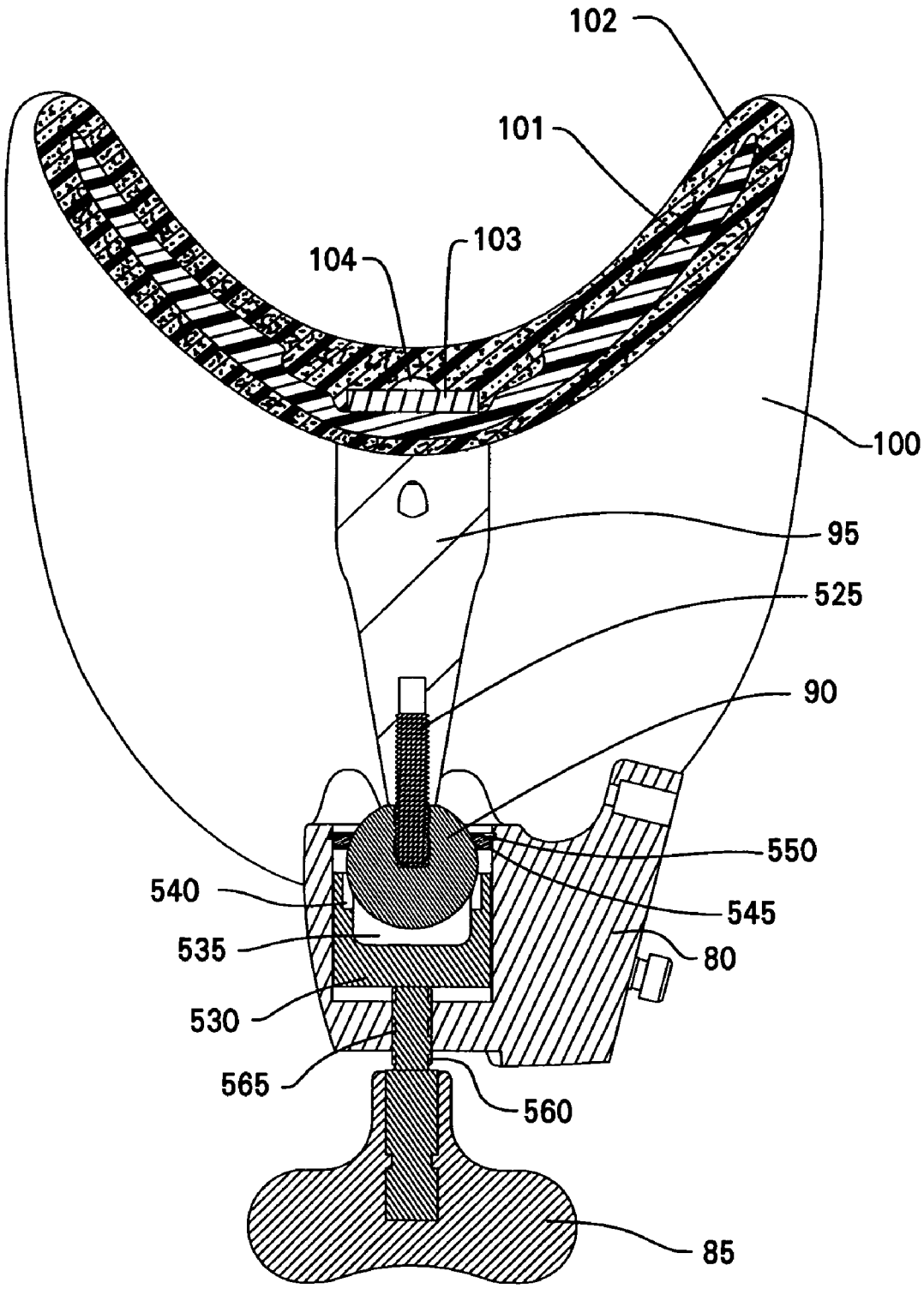
FIG. 27 is a partial cut-away end view of the calf support of FIGS. 24–26 in a locked position.

As best shown in FIGS. 26–27, the phenolic ball 90 is free to rotate or swivel within the housing 80 in FIG. 26, but as the T-locking handle 85 is threaded into the housing 80, it drives the sleeve 530 into the phenolic ball 90. The phenolic ball 90 is then locked between the sleeve 530 and the locking ring 545 to lock the calf support 100 in a fixed position.

Operation

The foot support and abduction assembly 10 according to the invention are substantially configured for one-handed operation by an attendant. In order to rotate the abductor 20 about pivot axis 110, an attendant need only grasp the distal end 194 of the abductor 20, simultaneously grasping the handle 190 to release the locking arm 155 from the ring gear 140. The abductor 20 is thereby free to rotate about the axis 110. Upon release of the handle 190 by the attendant, the abductor 20 is locked in its newly adjusted position.

The upright assembly 55 is slidably mounted on the abductor 20. In order to move the upright assembly 55 in a longitudinal direction on the abductor 20, the attendant need only grasp one of the first handle 330 or the second handle 335, thereby releasing the locking arm 260 and allowing the upright assembly 55 to slide longitudinally on the abductor 20. Since the attendant need only grasp one of the handles 330, 335, the attendant can move the upright assembly 55 while at the foot of the bed or at the head of the bed.

The foot support 65 is rotatable from a first position wherein the foot support 65 is available for use by a patient, and a second position wherein the calf support assembly 70 is presented to the patient. The foot support 65 is rotatable about the axis 105 and is released by an attendant depressing the push button 425, placing the attendant in a convenient position for rotating the foot support 65.

The upright assembly 55 is rotatably mounted to the abductor 20, from an upright deployed position to an under-bed stowed position. The upright assembly 55 is released to rotate to the under-bed stowed position by an attendant pulling on the stow-lever handle 475. While grasping the stow-lever handle 475, the attendant's hand is in position to support the upright assembly 55 for lowering. Once the pin 465 has cleared the aperture 470 of the hub 460, the attendant can release the handle 475 and, in a one-handed fashion, lower the upright assembly 55 to the stowed position. The upright assembly 55 will only rotate until the pin 465 reaches the stop/detent 507 of the hub 460. As the upright assembly 55 is lowered to the stowed position, the cam feature 510 operates to shift the cam wedge 275, thereby releasing the locking arm 260 to permit longitudinal movement of the upright assembly 55 on the abductor 20. The attendant can thereby conveniently lower the upright assembly 55 and shift it longitudinally on the abductor 20 with one hand.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A foot support and abduction assembly including:

at least one abductor configured for pivotal attachment proximate a maternity bed foot section;

a foot support;

a calf support attached to an undersurface of the foot support; and an upright assembly having a first end that is secured to the abductor for longitudinal movement along a length of said abductor and a second end to which the foot support is movably mounted, and a locking mechanism for selectively securing the upright assembly in one of a plurality of positions along the length of the abductor, the upright assembly being further configured for movement from a deployed position to a stowed position, said locking mechanism being configured to be unlocked when said upright assembly is in the stowed position.

2. The foot support and abduction assembly of claim 1, wherein said locking mechanism is configured to unlock in response to the movement of the upright assembly from the deployed position to the stowed position.

3. The foot support and abduction assembly of claim 1, wherein the upright assembly further comprises a second locking mechanism for securing the upright assembly in the deployed position, and the foot support is mounted on the upright assembly for movement between a first orientation and a second orientation, wherein the foot support is configured to simultaneously lock in the first orientation when the second locking mechanism is unlocked to rotate the upright assembly beneath the abductor.

4. The foot support and abduction assembly of claim 3, wherein the foot support is configured to remain locked when the upright assembly is in the stowed position.

5. The foot support and abduction assembly of claim 1, wherein the upright assembly further comprises a second locking mechanism for securing the upright assembly in the deployed position, and the foot support is mounted on the upright assembly for movement between a first orientation and a second orientation, wherein the second locking mechanism is configured to require the foot support be in the first orientation in order to unlock the second locking mechanism to facilitate movement of the upright assembly to the stowed position.

6. The foot support and abduction assembly of claim 5, wherein the foot support is configured to remain locked in the first orientation when the upright assembly is in the stowed position.

7. The foot support and abduction assembly of claim 1, wherein the abductor comprises a proximal end configured for pivotal attachment proximate the maternity bed foot section on a stanchion having a ring gear thereon, and the abductor further comprises a rotational locking mechanism for engaging the ring gear and securing the abductor in one of a plurality of rotational positions.

8. The foot support and abduction assembly of claim 7, wherein the rotational locking mechanism further comprises an unlock lever mounted at a distal end of the abductor.

9. The foot support and abduction assembly of claim 7, wherein the stanchion that mounts the abductor also mounts the maternity bed foot section.

10. The foot support and abduction assembly of claim 1, wherein the movement of the upright assembly from a deployed position to a stowed position is a rotational movement about a mounting hub.

11. The foot support and abduction assembly of claim 10, wherein the upright assembly further comprises a detent to prevent over-rotation of the upright assembly about the mounting hub and to resist shifting of the upright assembly from the stowed position.

12. The foot support and abduction assembly of claim 10, wherein the upright assembly further comprises a cam feature configured to unlock the locking mechanism.

13. The foot support and abduction assembly of claim 1, wherein the upright assembly further comprises a cam feature configured to unlock the locking mechanism.

14. The foot support and abduction assembly of claim 1, wherein the upright assembly further comprises first and second handles each configured for unlocking the locking mechanism.

15. The foot support and abduction assembly of claim 14, wherein the upright assembly and locking mechanism are configured for one-handed operation and movement along the abductor.

16. The foot support and abduction assembly of claim 1, wherein the calf support comprises a thermoformed insert and a urethane over-molded cover.

17. A foot support and abduction assembly including:

an abductor configured for attachment to a maternity bed;

a foot support configured for pivotal movement between a first orientation and a second orientation; and an upright assembly having an upper end and a lower end, the lower end of the upright assembly being pivotally and slidably mounted to the abductor and the upper end configured for mounting the foot support, the upright assembly being configured for movement from a deployed position to a stowed position, the upright assembly including a first locking mechanism for releasably securing the upright assembly in a longitudinal position on the abductor and a second locking mechanism for releasably securing the upright assembly in the deployed position, the foot support being pivotally mounted to the upper end of the upright assembly, the second locking mechanism being capable of releasing the upright assembly with the foot support in the first orientation, and the first locking mechanism being released when the upright assembly is in the stowed position.

18. The foot support and abduction assembly of claim 17, wherein the foot support is fixed in the first orientation in response to the upright assembly being in the stowed position.

19. A maternity bed having a foot support and abduction assembly, the foot support and abduction assembly comprising:

an abductor having a proximal end pivotally connected to the maternity bed, a rack section mounted to an underside thereof, and a pivot locking mechanism for fixing a pivotal position of the abductor relative to the bed, the pivot locking mechanism having an unlocking lever positioned at a distal end of the abductor;

an upright assembly having a mounting assembly slidably connected to the abductor and pivotally supporting the upright assembly, a slide locking mechanism for releasably fixing a longitudinal position of the upright assembly on the abductor, the upright assembly including a pair of opposed handles for unlocking the slide locking mechanism, a rotational lock for releasably fixing a rotational position of the upright assembly relative to the abductor; and a foot support pivotally connected to the upright assembly, the foot support having a rotation pin receiving aperture, the upright assembly including a foot support pivot and a rotation pin configured to engage the rotation pin receiving aperture in order to release the rotational lock.

20. The foot support and abduction assembly of claim 19, wherein the upright assembly further comprises a cam feature, the cam feature releasing the slide locking mechanism upon rotation of the upright assembly to a stowed position.

21. The foot support and abduction assembly of claim 20, wherein the foot support is pivotally fixed with the rotation pin engaging the rotation pin receiving aperture.

* * * * *